US005666747A

United States Patent [19]

MacQueen

[11] Patent Number: 5,666,747

[45] Date of Patent: Sep. 16, 1997

[54] LIGHTWEIGHT MODULAR SNOWPLOW FOR QUICK ATTACHMENT TO AND SIMPLE ECONOMICAL OPERATION FOR SMALL VEHICLE

[76] Inventor: James Patrick MacQueen, 32 Valley St., Keene, N.H. 03431

[21] Appl. No.: 587,989

[22] Filed: Jan. 17, 1996

Related U.S. Application Data

[63] Continuation-in-part of Ser. No. 183,173, Jan. 18, 1994, Pat. No. 5,485,690.

[51] Int. Cl.[6] ..... B62B 3/12; F01H 5/04

[52] U.S. Cl. ..... 37/273; 37/231; 280/79.11

[58] Field of Search ..... 37/231, 232, 233, 37/241, 240, 266, 270, 271, 272; 172/127, 219, 271, 772; 280/42.24, 655, 655.1, 79.11

[56] References Cited

U.S. PATENT DOCUMENTS

| | | | |
|---|---|---|---|
| 1,453,811 | 5/1923 | Starkweather . | |
| 2,430,221 | 11/1947 | Frink et al. . | |
| 3,155,255 | 11/1964 | Daniel | 280/47.24 X |
| 3,760,516 | 9/1973 | Billingsley . | |
| 3,845,577 | 11/1974 | Naymik . | |
| 3,881,261 | 5/1975 | Lavoie . | |
| 3,987,562 | 10/1976 | Deen et al. . | |
| 4,074,448 | 2/1978 | Niemala . | |
| 4,215,496 | 8/1980 | Wehr . | |
| 4,342,163 | 8/1982 | Hoekstra . | |
| 4,369,590 | 1/1983 | Miller . | |
| 4,439,939 | 4/1984 | Blau . | |
| 4,572,531 | 2/1986 | Elia | 280/62 |
| 4,658,519 | 4/1987 | Quenzi et al. . | |
| 4,680,880 | 7/1987 | Boneta . | |
| 4,735,424 | 4/1988 | Stelter, III | 280/47.24 X |
| 4,821,435 | 4/1989 | Pester | 37/231 |
| 4,821,436 | 4/1989 | Slocum . | |
| 4,907,358 | 3/1990 | Moore . | |
| 4,924,610 | 5/1990 | Sodeman . | |
| 4,962,599 | 10/1990 | Harris . | |
| 4,991,323 | 2/1991 | Benkler et al. . | |
| 5,002,304 | 3/1991 | Carrigan, Jr. | 280/655 |
| 5,027,536 | 7/1991 | Farrell et al. . | |
| 5,050,321 | 9/1991 | Evans . | |
| 5,050,898 | 9/1991 | Petrell, Jr. | 280/79.11 |
| 5,071,151 | 12/1991 | Irwin | 280/57.24 X |
| 5,075,988 | 12/1991 | Ciula et al. . | |
| 5,081,775 | 1/1992 | Veilleux . | |
| 5,129,170 | 7/1992 | Fusilli . | |
| 5,136,795 | 8/1992 | Rosenburg . | |
| 5,193,296 | 3/1993 | Reilley . | |
| 5,335,923 | 8/1994 | Langenback et al. | 280/79.11 |
| 5,524,917 | 6/1996 | Iverson et al. | 280/79.11 X |

*Primary Examiner*—Terry Lee Melius
*Assistant Examiner*—Robert Pezzuto

[57] ABSTRACT

A lightweight snowplow configured of a number of small components, each easily lifted, moved, assembled, disassembled and stored by an average individual. The snowplow is especially suitable for use with small vehicles such as small trucks, utility vehicles and cars. The snowplow features novel alternate arrangements for operational lifting, stopping and lowering of the snowplow and a quick-hitch/release mechanism for easy plow attachment purposes. The mounting structure to which the plow is attached and detached is designed so as to be able to fit most small utility vehicles with two fore and aft frame chassis members and a frame mounted metal bumper without need for welding or special custom fit-up. Finally, also featured is a novel approach for manual transport of and remote coupling and de-coupling of a snowplow to and from a vehicle, which may be utilized in Conjunction with almost any lightweight snowplow.

8 Claims, 13 Drawing Sheets

104
24
16
94a'
94b'
74'
112'
114'
94'
120'
124'
122'
118'
106
108
110'
116'
100
16
110
116
120
118
112
128
124
122
136
106
138
134
132
130
126

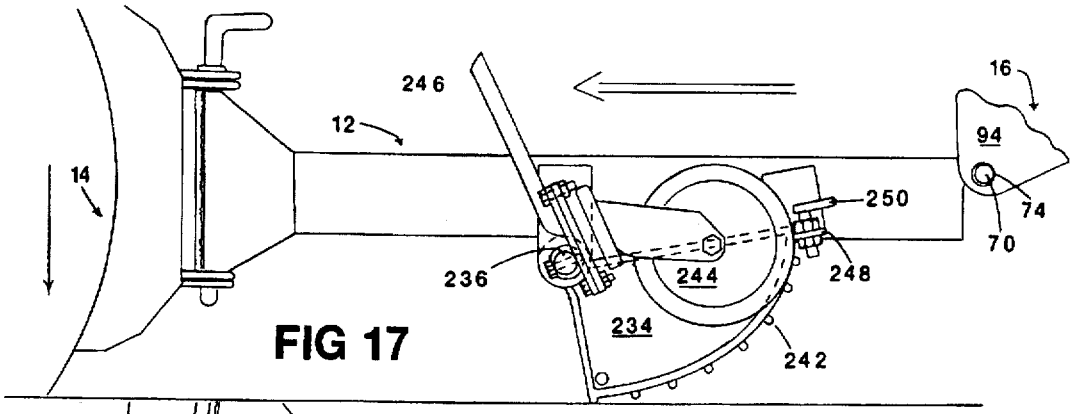
FIG 17
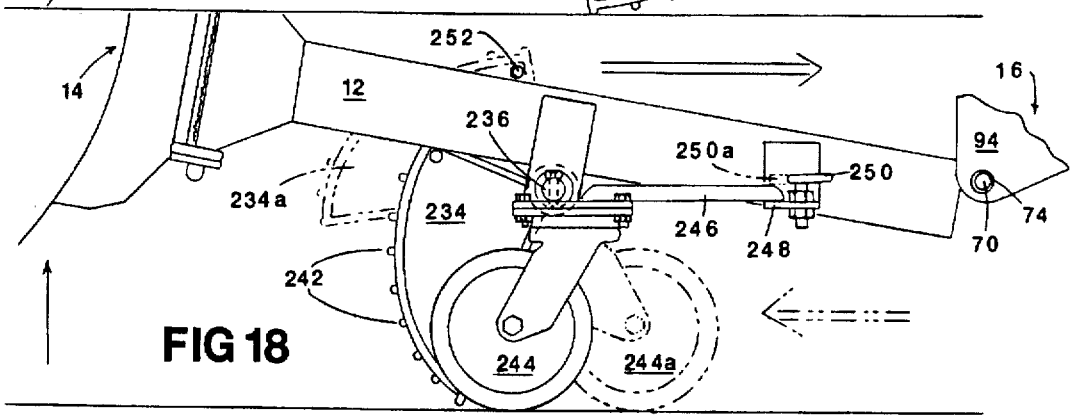
FIG 18
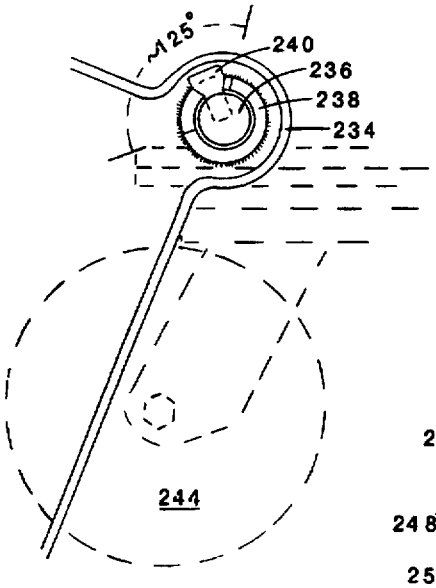
FIG 19A
FIG 19
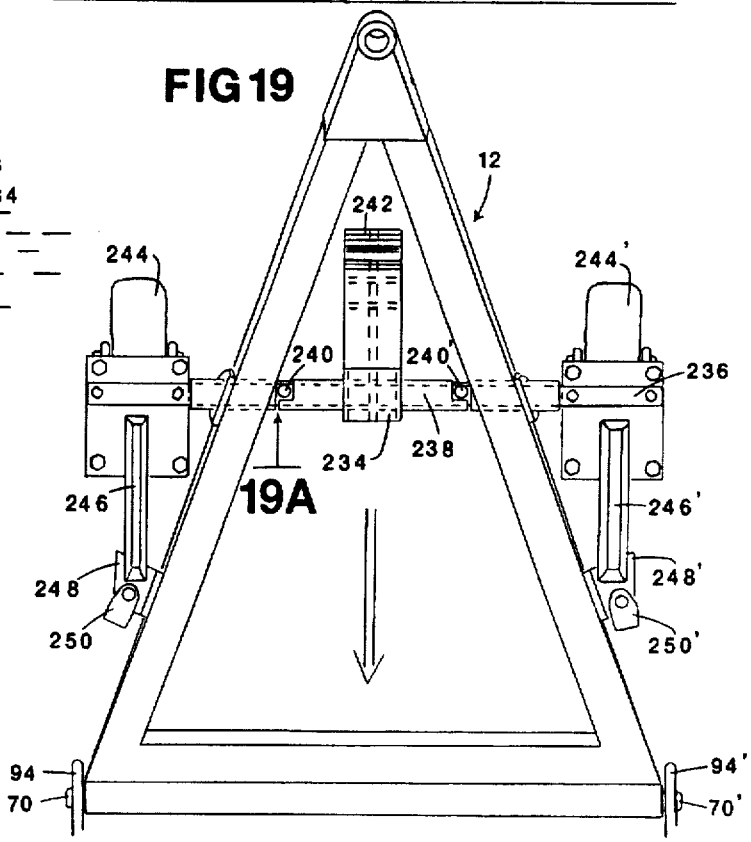

LIGHTWEIGHT MODULAR SNOWPLOW FOR QUICK ATTACHMENT TO AND SIMPLE ECONOMICAL OPERATION FOR SMALL VEHICLE

This application is a continuation-in-part of prior patent application Ser. No. 08/183,173 dated Jan. 18, 1994, now U.S. Pat. No. 5,485,690 and filed by the same applicant.

FIELD OF THE INVENTION

The present invention relates generally to the art of snowplows and more particularly to snowplows of the type which are suitable for use with small vehicles such as small trucks and cars.

BACKGROUND OF THE INVENTION

Many different types of snowplows are known to the art. Most such snowplows that are intended for common use with passenger vehicles tend to be heavy and cumbersome and difficult for the average person to couple and de-couple alone. Because of their size and bulk, they are not generally stored in the common residential garage but are usually stored outdoors in the weather where they take up considerable space, get in the way, and detract from the appearance of a residential neighborhood and deteriorate from unnecessary exposure to the weather.

Most such snowplows are operated by means of specially designed vehicle engine or electric powered hydraulic systems which are also heavy, add to the difficulty of initial fit-up of the vehicle mounting frame to the vehicle, and add significantly to the expense of such plows. Such plows of necessity usually have a single piece straight moldboard structurally strong and heavy enough to withstand the pushing and pulling of the hydraulic pistons while pivoting about the mid-point where the moldboard is connected to the plow frame.

Some plow moldboards are hinged in the center in order to provide various useful plowing configurations. These also are of necessity of heavy and complex construction that does not lend itself to easy and quick assembly and dis-assembly and storage. Because such hinged moldboards are usually hinged at (in the plane of) the moldboards themselves, the normal concave curve of the cold boards must be altered adding significantly to the weight, cost of construction and reducing moldboard operational efficiency.

Finally, almost all such plows must either be designed specifically for a particular make or model of vehicle or they must be custom-mounted, again at significant expense, by a shop with welding and metal-fabricating capabilities.

The development of a snowplow which overcomes all of the above difficulties of the prior art but retains the strength and versatility necessary to light truck or car snow plowing would be a significant advancement of the art.

OBJECTS OF THE INVENTION

The present invention relates to an improved small vehicle snowplow. A primary object of the invention is to provide a snowplow assembly of operational strength and versatility which can be used without significant modification on a variety of small trucks, utilities and cars.

Another object of the present invention is to provide a snowplow vehicle mounting frame that can be securely attached to most vehicles by the owner without welding or significant metal fabricating.

Another object of the present invention is to provide a snowplow assembly that is quickly and easily coupled and de-coupled to and from the vehicle mounting frame by an average person.

Another object of the present invention is to provide a snowplow assembly with a hinged two-part moldboard for operational versatility and modularity, but which is still light and strong and does not require complex construction therefore, and does not in its construction require alteration in any way of the normal moldboard curve.

Another object of the present invention is to provide a snowplow assembly of individual component parts small and light enough to be quickly and easily assembled, dis-assembled, lifted and moved by an average individual.

Another object of the present invention is to provide a snowplow assembly which can be easily moved around and which is of individual component parts small enough to be easily stored hanging on or along a wall in the average residential garage when not in use.

Still another object of the present invention is to provide a snowplow assembly that can be easily lifted, lowered and/or stopped in the lifted position by the vehicle driver while operating the vehicle from the driver's seat but without the aid of specially designed for snowplow use power sources such as engine driven or electric driven hydraulics.

DESCRIPTION OF THE DRAWINGS

The foregoing and still other objects of the invention will be more apparent from the following detailed explanation of the preferred embodiments of the invention in connection with the accompanying drawings herein in which:

FIG. 17 is a port side view of a third method of operation (raising, stopping and lowering) of the snowplow that requires only that the vehicle operator drive forward in the plow push mode wherein the plow is automatically lowered to the ground for plowing.

FIG. 18 is the same view as FIG. 17 except it depicts the vehicle moving in reverse which automatically lifts (raises) the plow and lowers the swivel castor wheels to the ground which support the plow in the raised position while the vehicle continues in reverse. This FIG. 18 also shows (in dashed lines) how the biased cam of the automatic lifting mechanism can be locked up out of the way and the castor wheel(s) locked in the down position for forward travel with plow in the raised position.

FIG. 19 is a top view of FIG. 18 showing the plow frame in the raised position with the castor wheels down and the vehicle moving in a rear direction.

FIG. 19A is a port side sectional view showing the detail of how the biased cam of the automatic lifting mechanism is free to rotate within a certain range about an axle. When the end of that range is reached in a counter-clockwise direction, the axle is forced to turn also in a counter-clockwise direction which forces the swivel castor wheels to rotate in the same direction up and off the ground.

DESCRIPTION OF THE ILLUSTRATED EMBODIMENT

Figure 1:
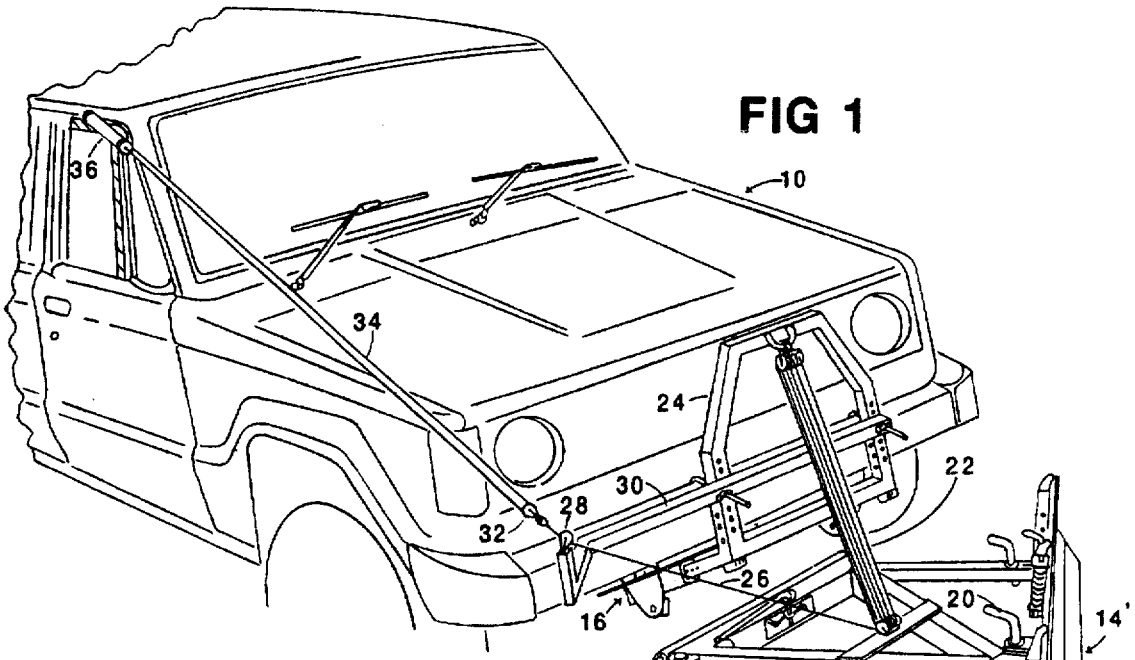
FIG. 1 is a perspective of the preferred embodiment of the snowplow assembly shown in a typical configuration and revealing most of the parts which are exterior to the vehicle. The plow frame is de-coupled from the vehicle and ready for mounting.

Referring now to the drawings and initially to FIG. 1, a vehicle designated generally by the reference numeral 10 is provided with a plow frame 12 and a two-part moldboard designated generally by the numerals 14 & 14'. The rear of the plow frame 12 in this figure is not coupled to the vehicle mounting frame 16.

Figure 2:
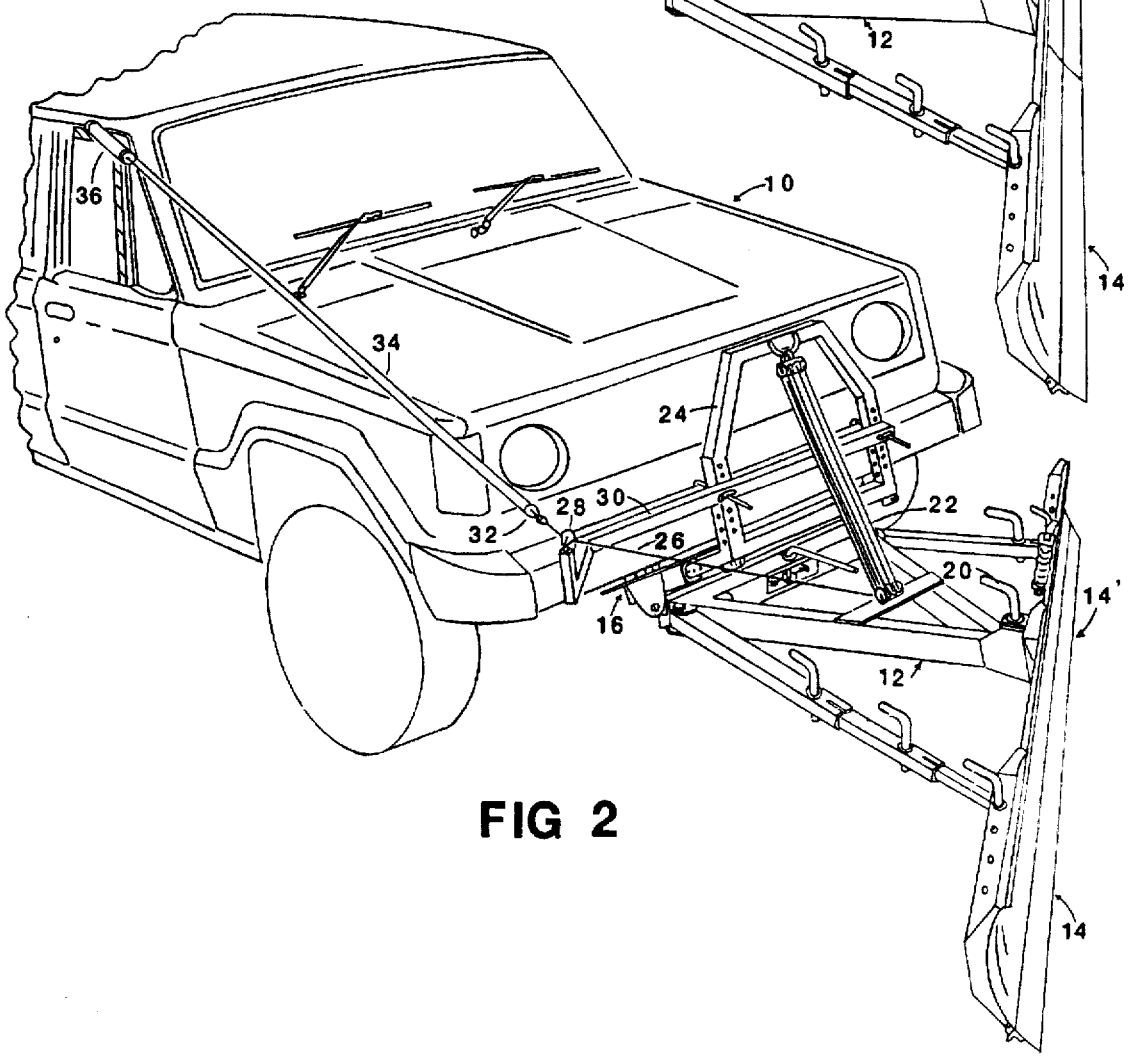
FIG. 2 is a perspective which is identical to FIG. 1 except that the plow frame has been coupled to the vehicle mounting frame.

Reference is next invited to FIG. 2, which reveals the same view as FIG. 1, except that the plow frame 12 in this view is coupled to the vehicle mounting frame 16 and ready for plowing. As is readily seen from FIG. 2 and FIG. 1, there are no specially designed for snowplow hydraulics or pneumatics utilized to operate the manual embodiment of this plow assembly. The assembly is designed so as to be able to be easily assembled and dis-assembled by one person without the aid of others or outside power sources.

Because of the tremendous weight of early machine plows, hydraulics have been the typical preference in the prior art both for lifting and angling snow plows as well in some cases for assisting in coupling and de-coupling the plow frame from the vehicle mounting frame. This is still true today. The present invention eschews this approach and employs instead in one embodiment (FIG. 1 & 2) a completely manual system for coupling the plow frame 12 to the vehicle mounting frame 16, for changing plow blade configurations, and for lifting, stopping, and lowering the plow remotely from the driver's seat during plowing operations.

This novel approach to small vehicle snowplowing utilizes a two-part plow moldboard 14 & 14' hinged together in the middle and attached to the front apex of the triangular snow plow frame 12 by means of one large pull-pin 20 in such a way that the dis-assembly of these three pieces is achieved instantly by removing said pin 20. Re-assembly of said three pieces is quickly achieved by reversing said operation. This design, by eliminating the hydraulics and the high strength (and therefore heavy weight) structure necessary thereto, allows a plow frame and moldboard assembly which is typically several hundred pounds in weight and therefore difficult for one person to handle and store, to be separated into three much lighter weight pieces (no more than 60# each even if made of steel) which are easy to handle and small and light enough to be stored out of the way or hanging in pieces on a garage wall.

Further, this novel approach utilizes a manual block and tackle (or other mechanical advantage) system 22 both for assisting in lifting the rear end of the plow frame 12 up into position for coupling with the vehicle mounting frame 16 and for selective raising, stopping and lowering the plow assembly from the driver's seat of the vehicle during plowing operations.

This block and tackle system 22 can be of different mechanical advantages depending on design preferences. The embodiment shown in FIGS. 1 & 2, reveals an 8-part block and tackle system 22 strung and connected in a detachable manner from the plow lifting frame 24 to a point somewhat forward of the mid-point of the plow frame 12. The free end of the line 26 led through the block and tackle arrangement and dead-ended therein, is led to a bullet block 28 at the end of an outrigger boom 30 that is attached to the plow lifting frame 24 as shown. Because of the 8:1 advantage, a person retracting this line 26 at this location in front of the vehicle when the plow frame 12 is not coupled to the vehicle mounting frame 16, can easily lift the rear end of the plow frame 12, connected to the moldboards 14 & 14', into position for coupling with the vehicle mounting frame 16 without having to get into the somewhat awkward stooped lifting position that is required otherwise to lift the rear end of the plow frame 12 into a coupling position.

Because the plow moldboard 14 & 14', even though relatively light, are far heavier than the rear end of the plow frame 12, only the rear end of the plow frame assembly lifts when the line 26 leading from the 8-part block and tackle system 22 is pulled in. This lifting system, when combined with the quick-hitch/release mechanism revealed in FIGS. 7, 8, & 8A yields a novel improvement in prior art for the quick and easy lifting and coupling and de-coupling of snow plow frames from vehicle mounting frames.

Figure 12:
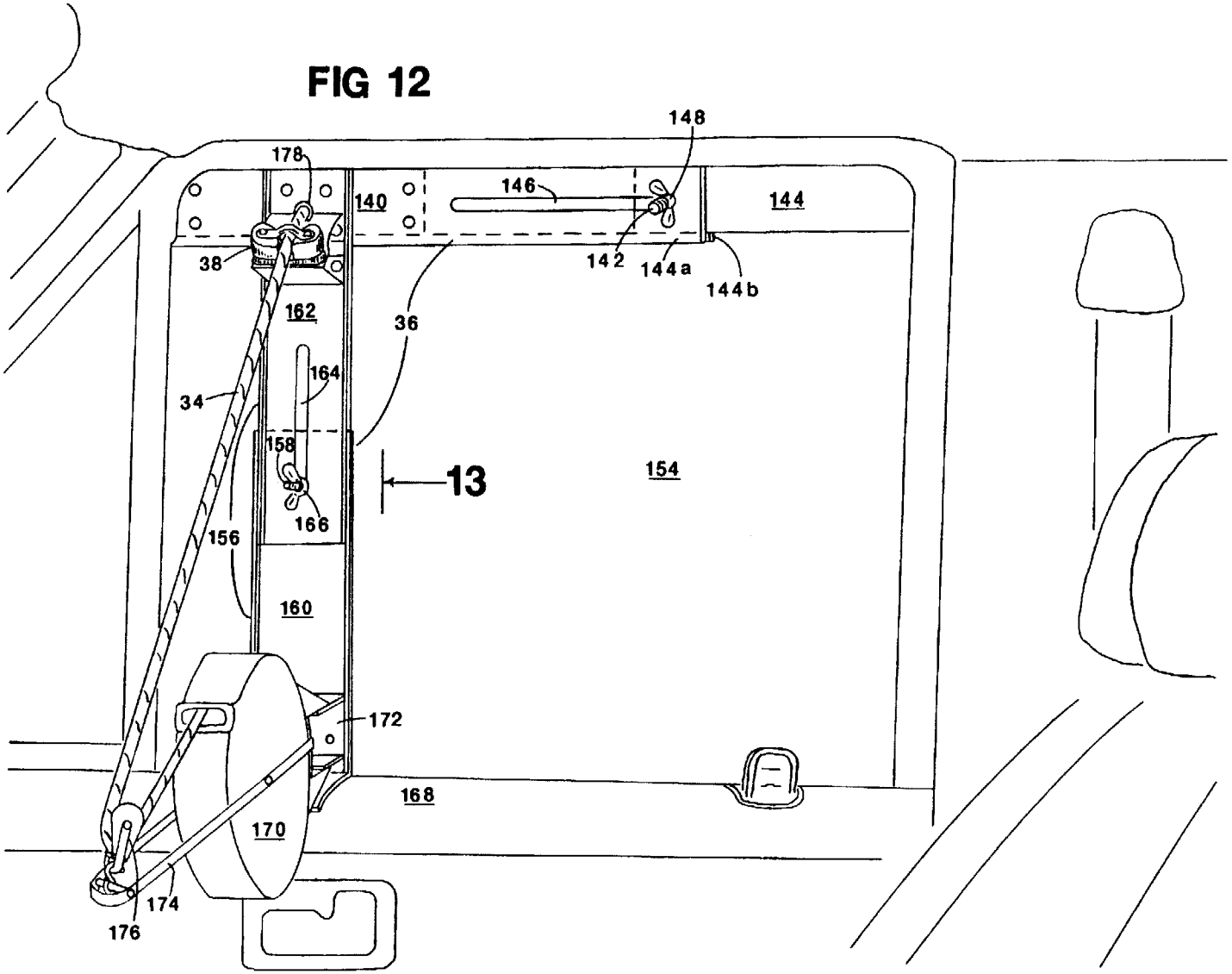
FIG. 12 is the interior of the vehicle looking from the driver's side to the passenger side window at the preferred embodiment of the vehicle interior portion of the remote line control device of the manual plow lifting arrangement.
Figures 13, 13A:
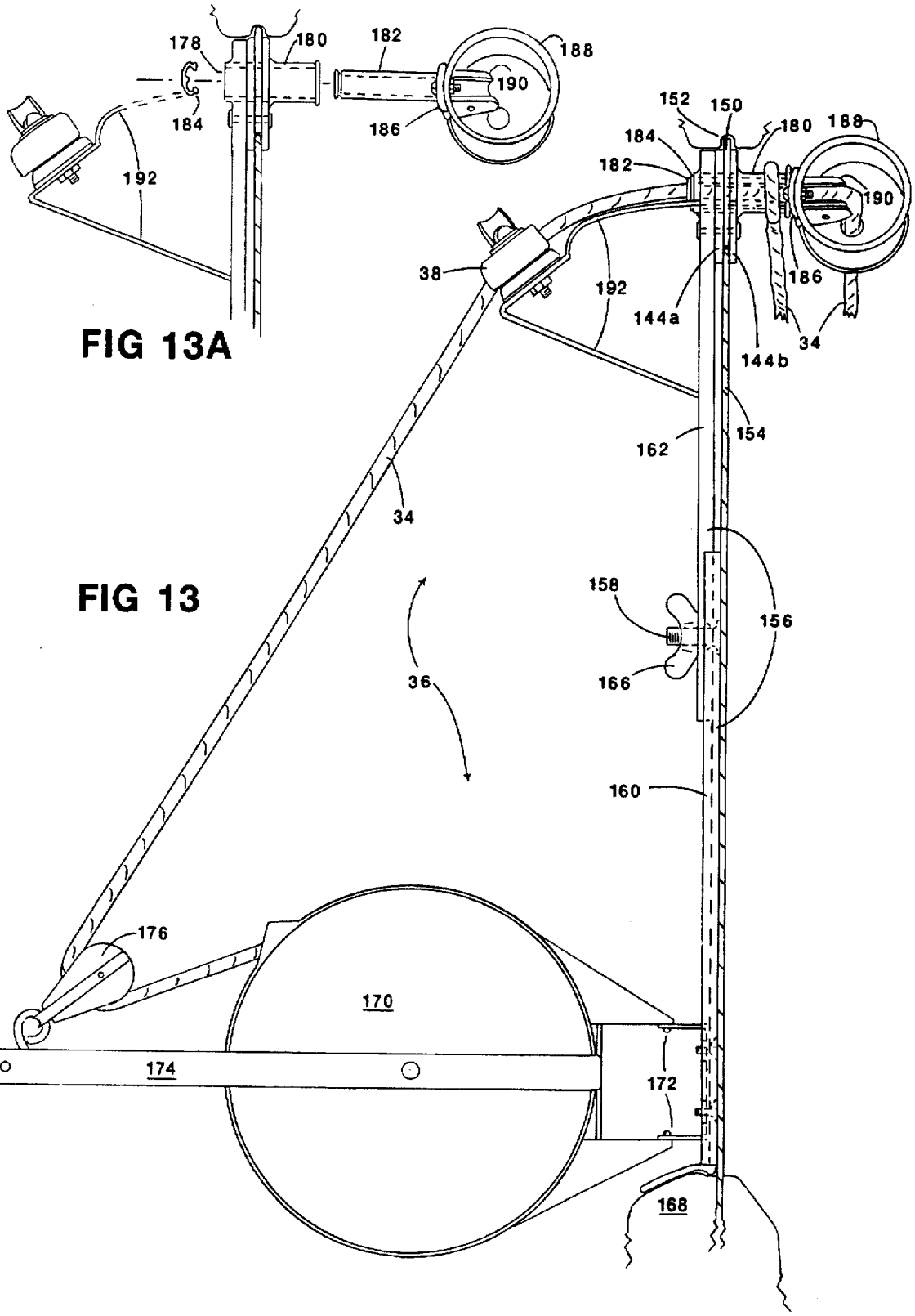
FIG. 13 is a side view looking forward through the passenger side door window of the vehicle of said remote line control device of the manual plow lifting arrangement.
FIG. 13A is the same view as FIG. 13 of the top portion of the remote line control device except it is exploded to show how this portion fits together.
Figure 14:
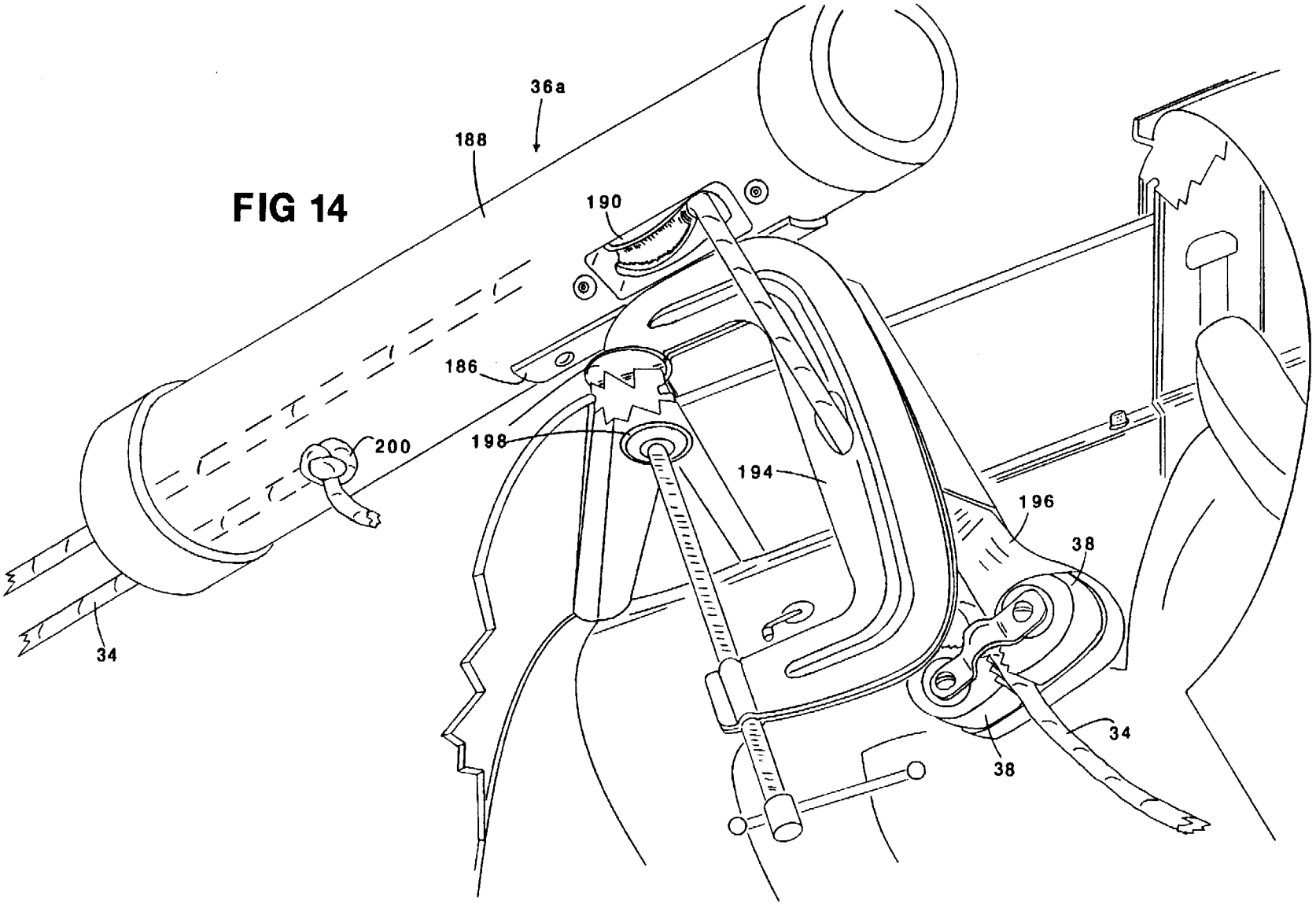
FIG. 14 is a cut-away perspective looking down of another simpler embodiment or, said remote line control device.

Once the line 26 from the block and tackle lifting system 22 passes through the bullet block 28 at the end of the outrigger boom 30, it is, in this embodiment, attached to a 2-part moving cascade block 32. Another line 34 is dead-ended at the remote line control device 36 installed at the starboard side vehicle window as shown in FIG. 1, and then led through this moving cascade block 32 and back to the remote line control device 36 and into the vehicle where the driver of the vehicle has it within easy reach. This 2-part system when combined (cascaded) with the 8-part system yields a 16:1 mechanical advantage for the driver of the vehicle. When the plow frame 12 now couple to the vehicle mounting frame 16 cannot rise any more as it did in the coupling operation. The only thing that can and does rise now is the front end of the plow frame 12 and the plow moldboards 14 & 14' with it. If the driver of the vehicle lets the line 34 back out, the plow assembly by gravity lowers back to plowing level or any level that the driver chooses. An automatic spring-loaded cam cleating mechanism 38 mounted integral to the remote line control device 36 as shown in FIGS. 12, 13, & 14 allows the driver to 'stop' the plow blade at any height chosen without the driver having to continuously hold onto the line 34 or wrap it around a cleat fixture.

Figure 4:
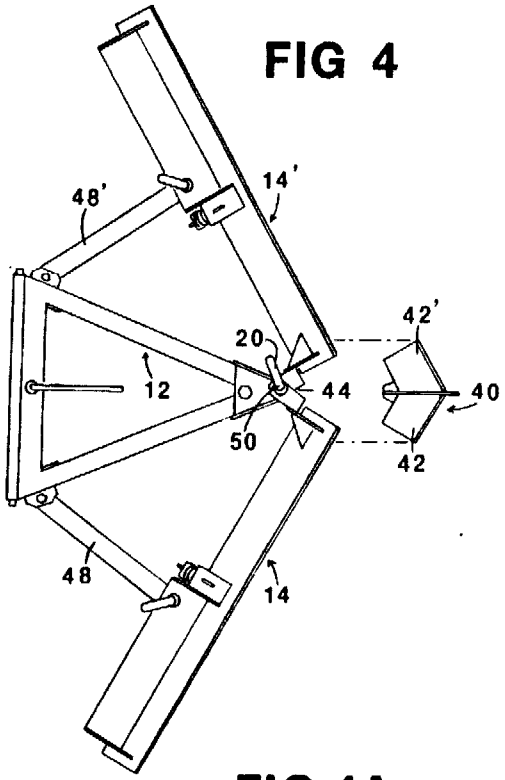
Figure 4A:
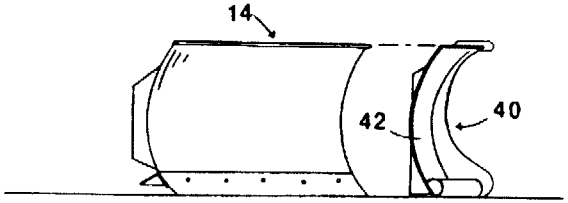
FIG. 4A is a side view of FIG. 4 showing the nose cone which is attached is in said 'V' configuration.
Figure 3:
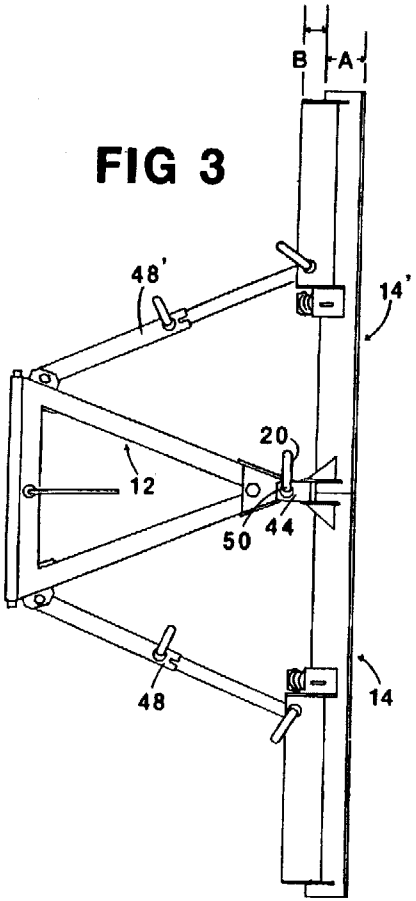

Referring now to FIG. 3, a top view of the assembled plow frame 12 and 2-part moldboard assembly 14 & 14' in the 'straight blade' configuration is revealed. FIG. 4 is a top view of the plow assembly in the 'V' configuration. A 'V' nose cone 40 is shown detached for illustration purposes in FIG. 4, and side view FIG. 4A. Said nose cone 40 is necessary to fill the gap created between the moldboards 14 & 14' when the 'V' configuration is utilized. The truncated moldboards 42 & 42' of this nose cone 40 are designed to fit (reflect the curve and angle) of the two plow moldboards 14 & 14' in said 'V' position. This nose cone 40 can be quickly attached and detached from the two plow moldboards 14 & 14' when different plow configurations are desired by a variety of conventional fastening means which are not discussed here.

Figure 5:
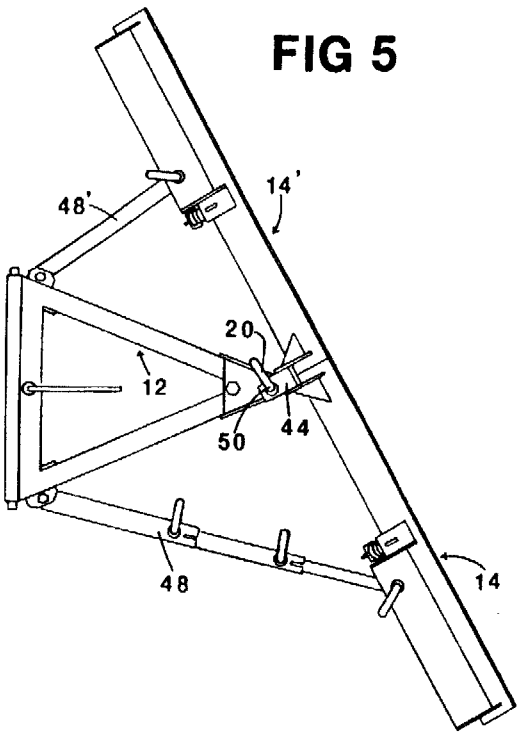
FIGS. 3, 4, & 5 are top view of the plow and plow frame in the various configurations achievable of straight plow, V-plow and angle plow respectively.

FIG. 5, is a top view of the plow assembly in an angled position which can obviously be reversed in the opposite angle direction. Changes to each of these moldboard configurations are achieved by the operator manually swinging the moldboard 14 & 14' to the desired position about the pivot point 50 resulting from the connection of the offset hinge 44 by means of the main pull-pin 20 to the vertical pipe 46 (see FIG. 6) mounted on the front of the plow frame 12. These changes in moldboard configuration can be achieved with the moldboards 14 & 14' resting on the ground or in the raised plow position. Plow frame extension arms 48 & 48' are provided to support the moldboards 14 & 14' in a fixed position relative to the pivot point 50 in any of the chosen configurations.

The offset hinged 2-part moldboard design affords both a lighter weight overall construction design and the storage and handling advantages of modularity as well as the operational efficiency and flexibility provided by these varying blade configurations.

Figure 6:
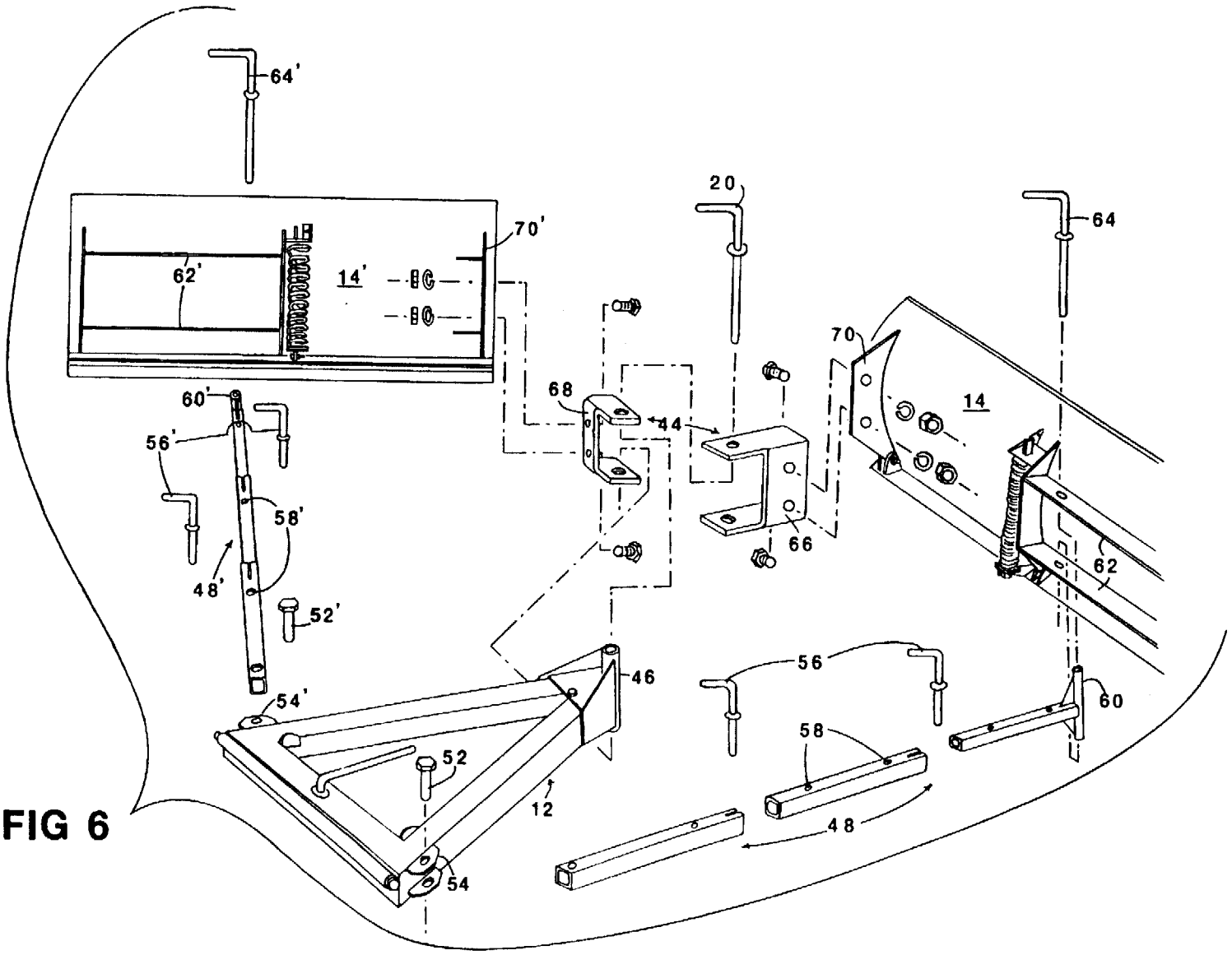
FIG. 6 is an exploded perspective view of the structure and workings of the plow moldboards and plow frame showing how the various parts fit together by means of the offset hinge and the extension support arms.

This offset hinged 2-part moldboard design is also unique insofar as it allows for the continuous normal horizontal concave curve of the moldboard to be maintained because it 'offsets' the pivot point 50 to a point in a plane 'B' that is completely behind the rear-most vertical plane 'A' of the moldboards 14 & 14' as shown in FIG. 3. Most hinged moldboards are hinged in the center within the vertical front/rear plane 'A' of the moldboards and typically either must eliminate or radically alter this normal horizontal concave curve of the moldboards at the location of the hinge in order to accommodate it and maintain the strength necessary thereto. This traditional approach generally requires an increase in weight, much more complex construction of the moldboards and the plow frame at this hinge location and hence more deconstruction expense; and finally, results in a system that does not allow for the easy attachment and detachment of the moldboards from the plow frame and the moldboards from each other. The illustrated design of the present invention solves all of those drawbacks of prior art. FIG. 6, is an exploded perspective view of the details of this design and how its various component parts fit together.

As further reference to FIG. 6, reveals, the two moldboards 14 & 14' resemble one conventional straight plow moldboard cut in half. They do not however have the heavy turntable and other reinforcing structures in the middle proximate to where the front end of the plow frame 12 attaches which are necessary to conventional power-angled plow moldboards. Such conventional plow moldboards require this heavy construction because such plows are supported entirely from the center area of the plow. The hydraulic pistons that angle the conventional plow are typically connected to the back of the moldboard at a location on either side of the center pivot point which is relatively close to that pivot point. Accordingly, the moldboard must be much more heavily reinforced in order to support itself for its entire length during plowing and when it is being hydraulically re-angled under load.

In contrast, while the design of the present invention does not allow the moldboard 14 & 14' to be re-angled while under operation or load, that fact, plus plow frame extension arms 48 & 48' that support the moldboards 14 & 14' at a distance significantly further from the center pivot point 50 (see FIGS. 4, 5, & 6) allows for much lighter moldboard construction which in turn allows for the many features itemized herein which are of particular advantage to a snowplow that is intended for smaller vehicles and lighter plowing jobs. In these applications, ease of storage, handling, assembly, vehicle attachment and de-tachment as well as ease of operation are the paramount considerations.

This particular embodiment includes a conventional spring-actuated trip blade on each moldboard for easier and safer plowing. However, such is not part of the present invention nor is it necessary to the design if lighter weight or less expense in construction are desired.

Each of the two plow frame extension arms 48 & 48' that support the moldboards in the various configurations, are connected to each side of the rear of the plow frame 12 by means of pins 52 & 52' that allow them to change their angle around said connection points 54 & 54' as required for the different moldboard configurations. Each multi-pad extension arm 48 & 48' is constructed of several pieces of tubing which fit inside each other in such a way to allow for manual telescoping extension and retraction of each arm 48 & 48' as necessary for each moldboard configuration. Each extension arm length is controlled by no more than two pull-pins 56 & 56' for each arm 48 & 48', which pull-pins 56 & 56' are inserted into holes 58 & 58' located in each of the tubes so as to be able to stop arm extension at the desired extension length. At the outboard end of each extension arm 48 & 48', a vertical pipe fitting 60 & 60' is attached, which allows the outer end of the extension arms 48 & 48' to be connected or disconnected to the frame reinforcing structures 62 & 62' on the back side of the moldboards 14 & 14' by means of pull-pins 64 & 64'.

Again referring to FIG. 6, attention is directed to the offset hinge 44 by which the two moldboards 14 & 14' are joined to the plow frame 12 and which serves to allow the various moldboard angle configurations without reconfiguration of the moldboard shape or structure itself and which allows for simple assembly and dis-assembly. Each of the two pads 66 & 68 of the offset hinge 44 can be bolted or permanently attached (welded) to the inner most moldboard reinforcing structures 70 & 70'. One side or part 68 of the offset hinge 44 is dimensioned vertically so as to be able to fit or slip inside the inner vertical dimension of the other side or pad 66 which together form the offset hinge 44. The hole in the reinforced vertical pipe 46 attached to the forward end of the plow frame 12 becomes the recessed from the vertical moldboard plane, pivot point 50 for the offset hinge 44 and hence the moldboards 14 & 14'. Said reinforced vertical pipe 46 is sized so as to fit vertically within the inner dimension of the smaller part 68 of the offset hinge 44 thereby allowing the main pull-pin 20 to pass first through the aligned holes in the upper offset surfaces of the two hinge parts 68 & 66, then through the reinforced vertical pipe 46 and then through the aligned holes in the lower offset surfaces of the two hinge parts 66 & 68. When the main pull-pin 20 is in place connecting the two parts of the offset hinge 66 & 68 and hence the two moldboards 14 & 14' to the forward end of the plow frame 12, and the pull-pins 64 & 64' for the two extension arms 48 & 48' are in place connecting the extension arms 48 & 48' to the respective moldboards 14 & t4' and regulating the extension arm length for the desired moldboard configuration, the plow frame 12 and moldboard assembly is connected and ready to be attached to the vehicle mounting frame 16 for operation as previously described. The triangular shaped plow frame 12 itself is constructed of steel box members.

Alternatively, the plow frame 12 can first be coupled to the vehicle mounting frame 16 and then the moldboards 14 & 14' can be joined to the plow frame 12 as described above by means of the main pull-pin 20 and the extension arm connecting pull-pins 64 & 64'.

Figure 8:
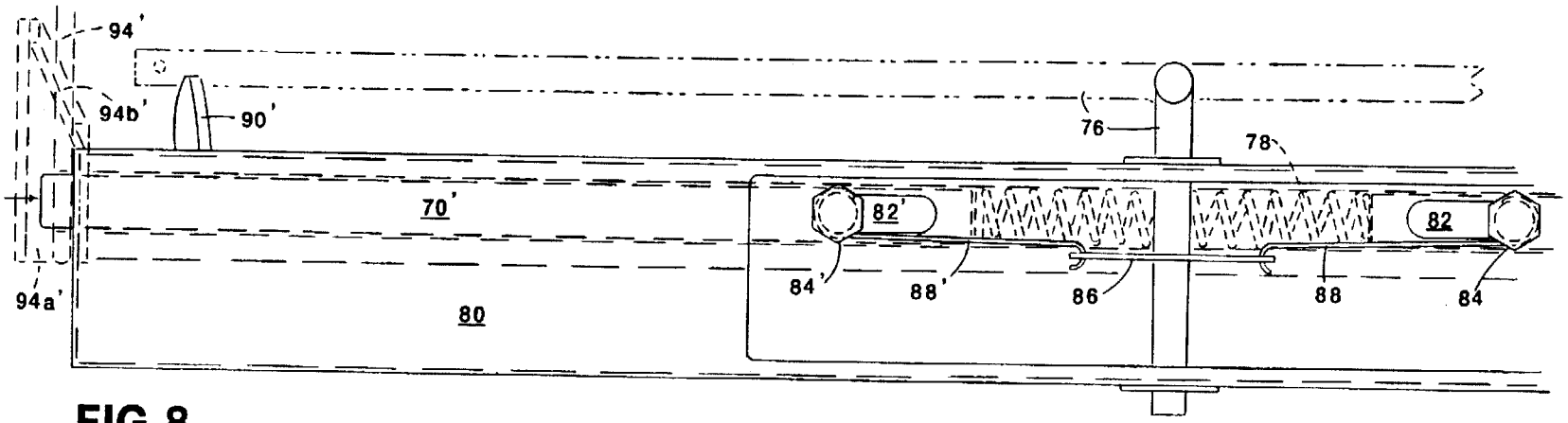
FIG. 8 and 8A are respectively an interior side view looking aft of the plow frame quick-hitch/release mechanism and a starboard side end view of the attachment of the pipe containing the quick-hitch/release compression spring and coupling pins to the rear box member of the plow frame.
Figure 8A:
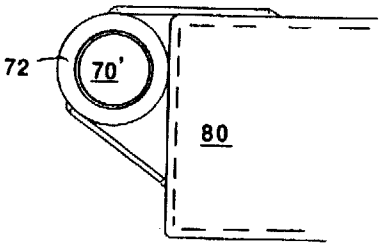
Figure 7:
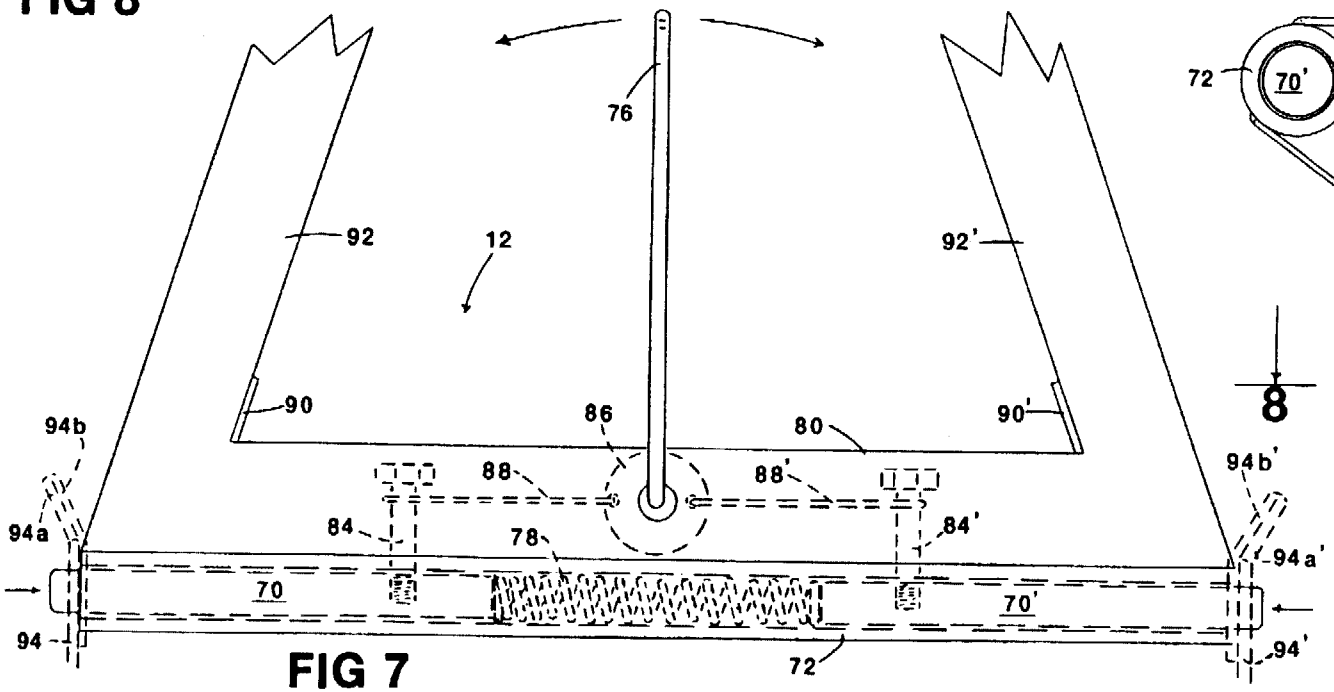
FIG. 7 is a top-view detail of the plow frame quick-hitch/release mechanism which couples and de-couples the plow frame to and from the vehicle mounting frame.

FIGS. 7, 8, & 8A, provide details of the unique quick-hitch/release mechanism located at the rear of the plow frame 12 which allows for the instantaneous coupling and de-coupling of the plow frame 12 to and from the vehicle mounting frame 16 once the spring-actuated pins 70 & 70' located in the steel pipe 72 attached to the rear of the plow frame 12 are properly aligned with the receiving holes 74 & 74' (FIG. 9) in the vehicle mounting frame 16. The plow frame 12 can then be instantaneously removed from the vehicle mounting frame 16 when desired simply by pushing the readily accessible plow frame lever arm 76 to the left or the right.

As is readily seen in FIGS. 7 & 8, this quick-hitch/release mechanism consists of two steel pins 70 & 70' inside a steel pipe 72 separated by a compression spring 78 which always works to push both pins 70 & 70' to the outer extremities of the pipe 72 which is permanently attached horizontally (see FIG. 8A) to the upper face of the rear box member 80 of the plow frame 12. When the compression spring 78 is able to be in the fully extended position, the two pins 70 & 70' are sized to protrude a pre-determined length from either end of the pipe 72. At a location close to the inboard end of each pin, slots 82 & 82' (FIG. 8) are provided in the steel pipe 72 which align with similar slots 82 & 82' in the same location in the back face of the rear box member 80 of the plow frame 12 so that bolts 84 & 84' may be tapped into each respective pin 70 & 70' in such a way that when each pin 70 & 70' is forced inward against the pressure of the spring 78, it travels a distance sufficient to allow the outboard exposed portion of each pin 70 & 70' to retract entirely within the pipe 72.

The inward force referred to above is provided by a lever 76 which is comprised of a circular disk 86 (or other shape which accomplishes the same purpose) mounted horizontally in a fixed position through its center within the rear box member 80 of the plow frame 12 on a steel rod (lever) 76 that passes vertically through the center of the plow frame 12 rear box member 80. This steel rod (lever) 76 is fixed in the box member 80 so that it cannot move in either direction vertically but remains free to be rotated in the holes that it passes through at the top and bottom of the rear box member 80 of the plow frame 12. At a pre-determined distance above the box member 80, the steel rod (lever) 76 is bent at approximately a right angle so that it runs forward in a horizontal plane thus forming the easily accessible lever arm 76 for the quick-hitch/release mechanism. The horizontal portion this lever arm 76 is normally held in this forward position because the connecting rods 88 & 88' are connected between each tapped bolt 84 & 84' and the horizontally fixed disk 86 in such a way that when the lever arm 76 is pushed either to the left or right thereby rotating the disk 86 in one direction or the other, each connecting rod 88 & 88' is free to change its angular relationship with both the bolt 84 & 84' and the disk 86 it is connected to. Since each bolt 84 & 84' tapped into its respective pin 70 & 70' is continually attempting to move away from the lever arm disk 86 because of the continuous outward force applied by the compression spring 78, the connecting rods 88 & 88' are continually attempting to 'pull' the lever arm disk 86 into a position in which the lever arm 76 is pointed directly forward.

Conversely, if pressure is applied to the lever arm 76 forcing it horizontally to the left or the right, the disk 86 is forced to rotate with it thereby forcing by means of the connecting links each bolt 84 & 84' and hence each pin 70 & 70' each bolt 84 & 84' is tapped in to, to move toward each other against the continuous pressure of the compression spring 78 with considerable mechanical advantage achieved by the horizontal length of the lever arm 76.

If the lever arm 76 is force to move approximately 90 degrees horizontally in either direction, the exposed outboard portion of the pins 70 & 70' at both ends of the steel pipe 72 retract to the unexposed position. Cam-shaped stops 90 & 90' are provided at the top of either side of the plow frame 12 at the intersection of each plow frame side box member 92 & 92' with the plow frame rear box member 80 located so as to be just within the radius of the lever arm 76 when it is forced to either extreme position when slipped over either cam stop 90 & 90', thereby holding both coupling pins 70 & 70' in the retracted position. This allows all the hands of the operator to be free for achieving the proper alignment of both coupling pins 70 & 70' with each receiving hole 74 & 74' (FIG. 9) in the vehicle mounting frame 16.

Even this alignment need not be perfect before releasing the lever arm 76 from the cam stop 90 & 90' holding it. The lever are 76 can in fact be released at any time that the ends of the steel pipe 72 with the retracted coupling pins 70 & 70' are within the two opposing vertical plane surfaces 94 & 94' of the vehicle mounting frame 6 and relatively close to the receiving holes 74 & 74'. Releasing the lever arm 76 from the cam stop 90' at this point results in the compression spring 78 forcing the two pins 70 & 70' out with enough force against the opposing vertical surfaces 94 & 94' in which the receiving holes 74 & 74' are located to hold the entire rear portion of the plow frame 12 temporarily in place even if no lifting assistance as previously described is used. From this point as each pin 70 & 70' is aligned with its respective hole 74' & 74, it automatically pops into it even if the opposing pin has not. This makes alignment of the two opposing pins 70 & 70' with their respective opposing holes 74' & 74 even easier and eliminates the need to have both pins 70 & 70' perfectly aligned with their respective holes 74' & 74 before releasing the lever arm 76 and 'popping' the pins 70 & 70' into their respective receiving holes 74' & 74.

Figure 9:
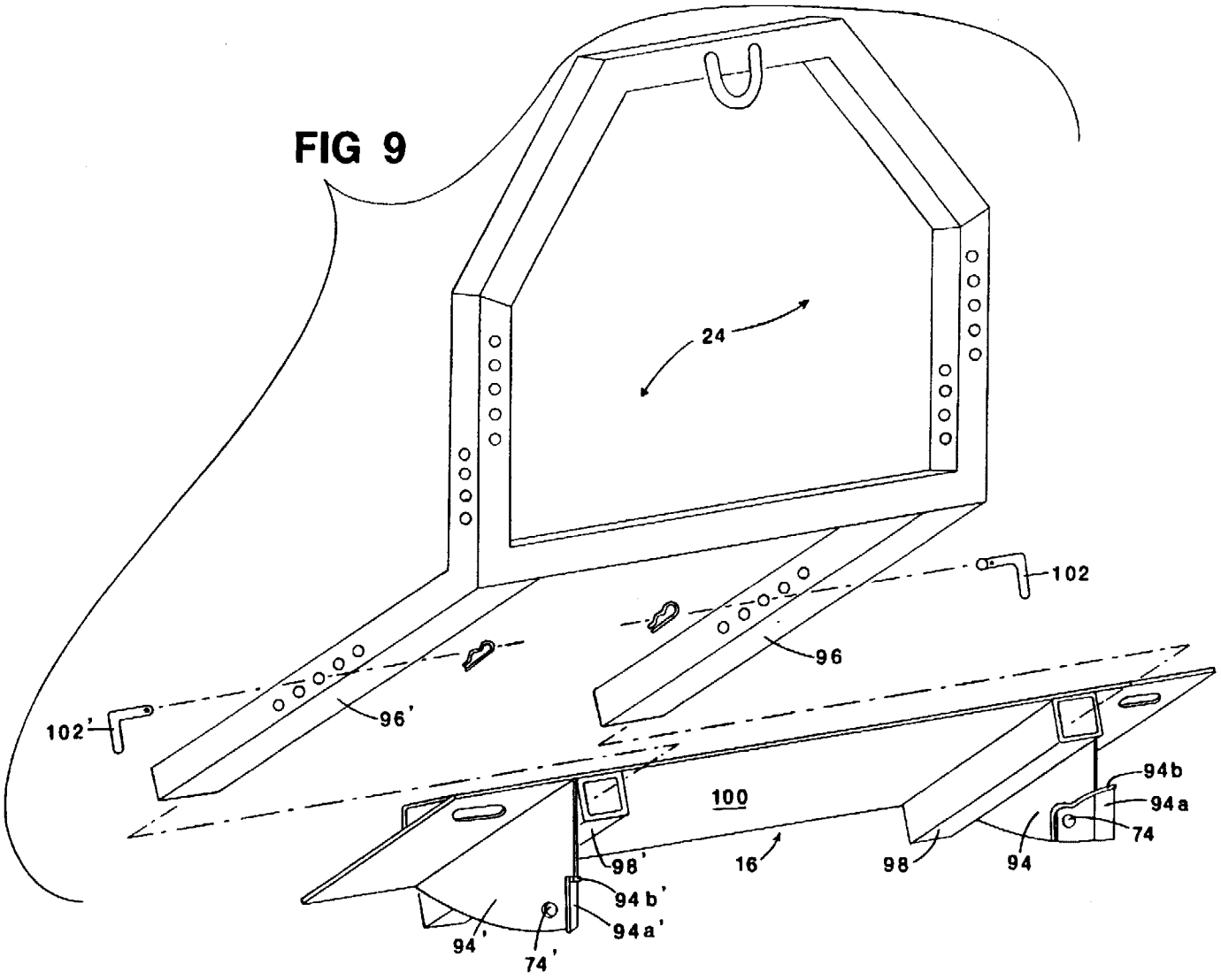
FIG. 9 is a perspective of the vehicle mounting frame and the plow lifting frame which fits into it.

FIGS. 7, 8 & 9, further reveal attached to each vertical surface 94 & 94' of the vehicle mounting frame 16 outwardly angled centering flanges **94*a* & 94*a'* which serve to center the rear of the plow frame 16 when it is being inserted into the plow frame 16. They also serve to automatically compress the protruding coupling pins 70 & 70' into the pipe 72 when the plow frame 16 is forced rearward into the mounting frame 16, thereby making unnecessary pre-rotation of the lever arm 76 to a retaining stop 90 & 90'**.

FIGS. 7, 8 & 9 also reveal positioning guides **94*b* & 94*b'* which are fixedly attached to the inner surfaces of each mounting frame vertical surface 94 & 94' and each centering flange 94*a* & 94*a'* which serve to limit rear and upward movement of the rear of the plow frame 16 when it is being inserted into the vehicle mounting frame 16. These positioning guides 94*b* & 94*b'* are located and configured obliquely, horizontally and vertically so that the pipe 72 on the rear of the plow frame 16 is guided into a final resting position, as it is moved rearward and upward as far as it will go, which automatically and independently aligns the coupling pins 70 & 70' with their respective receiving holes 74 & 74' in the vertical surfaces 94 & 94' of the vehicle mounting frame 16**, thereby achieving almost automatic coupling.

De-coupling the plow frame 12 from the vehicle mounting frame 16 is even easier. Al that is required is for a person to push the lever arm 76 (with hand, foot or stick) in either horizontal direction far enough to fully retract the coupling pins 70 & 70' and the plow frame 12 instantaneously de-couples without further effort.

FIG. 9, reveals how the plow lifting frame 24 fits into the vehicle mounting frame 16. Each leg 96 & 96' of the lifting frame 24 is inserted into the respective steel tubes 98 & 98' which are permanently mounted at approximately a 30 degree angle to the ground at each intersection of the two opposing vertical surfaces 94 & 94' of the vehicle mounting frame 16 in which the coupling receiving holes 74 & 74' are located, with the main surface 100 of the vehicle mounting frame 16. The two legs 96 & 96' of the plow lifting frame 24 are inserted into these two tubes 98 & 98' to a point which provides the right height for the exposed vertical portion of the plow lifting frame 24 and the right distance from the vehicle bumper 104 (see FIG. 11). This vertical and horizontal adjustability of the plow lifting frame 24 provided by the oblique angle to the ground of the steel tubes 98 & 98' on the vehicle mounting frame 16 and the legs 96 & 96' of the plow lifting frame 24 is a significant improvement over prior art because of its ready adaptability to different vehicles. Pull pins 102 & 103' are then inserted in each leg 96 & 96' in the hole closest to the front end of the tubes 98 & 98' which prevents further inward movement of the lifting frame legs 96 & 96' into the tubes 98 & 98'. The oblique mounting angle of the tubes 98 & 98' prevents further outward movement.

Figures 10, 11:
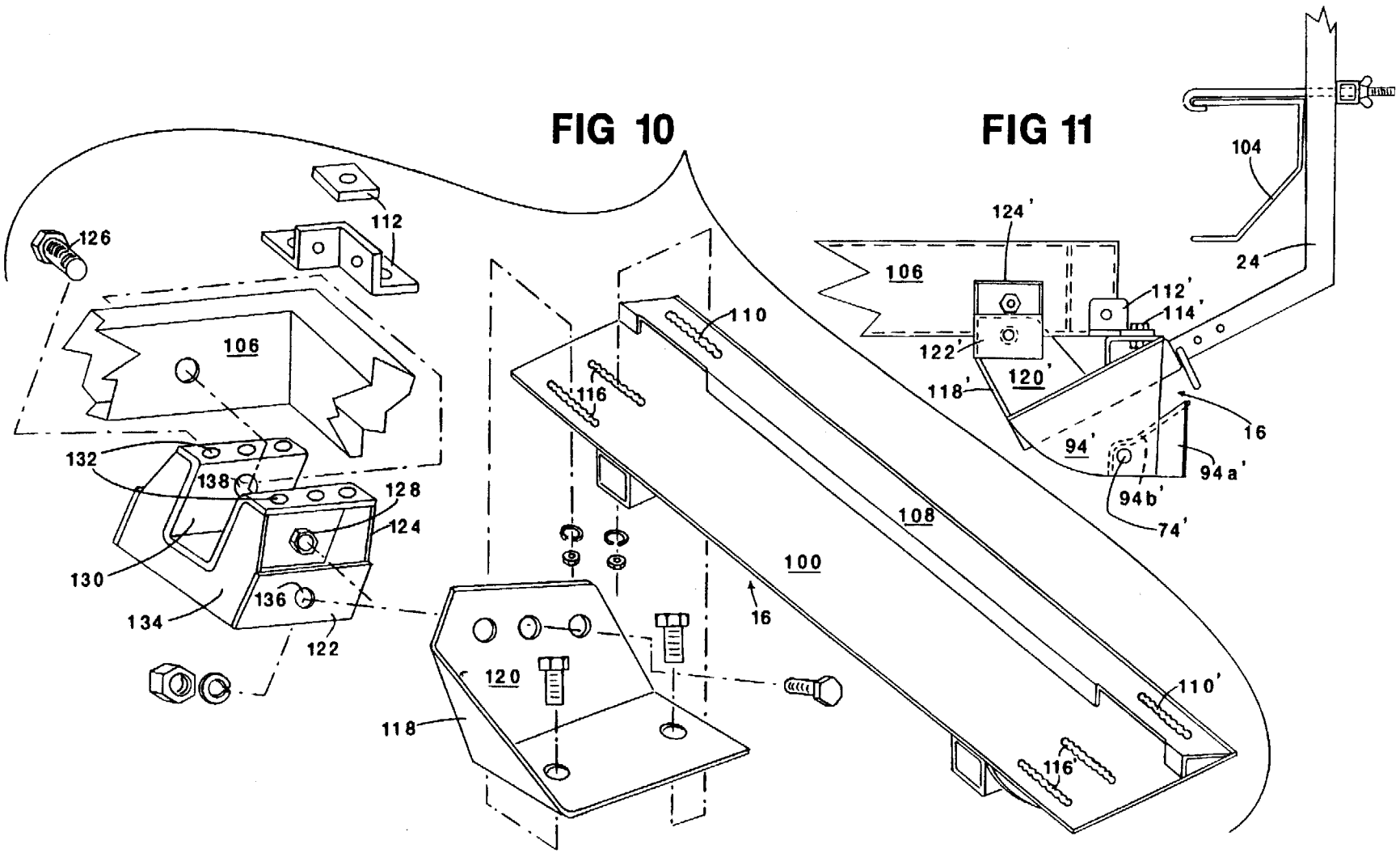
FIG. 10 is an exploded perspective of the typical manner in which the port side of the vehicle mounting frame is attached to the port side of the vehicle chassis frame.
FIG. 11 is a starboard side view of the vehicle chassis frame and bumper and a typical manner in which the vehicle mounting frame and plow lifting frame are attached to the vehicle.

The vertical portion of the lifting frame 24 can then be attached to the vehicle bumper 104 as shown in FIG. 11. Attachment to the bumper 104 adds rigidity to the vehicle mounting frame 16 and the plow lifting frame 24. The plow lifting frame 24 can also be used as a means of attachment for the outrigger boom 30 as shown in FIG. 1.

FIG. 10, is an exploded perspective of and FIG. 11, is a starboard side view of a typical method by which the vehicle mounting frame 16 may be attached to the main chassis frame 106 of the vehicle. The angled cross-piece member 108 attached to the vehicle mounting frame main surface 100 provides rigidity to said vehicle mounting frame main surface 100. Said angled cross-piece member 108 is provided with a number of adjacent overlapping holes 110 & 110' on each side so that the corner brackets 112 & 112' can be bolted to it in such a way as to fit snugly both corners of most vehicle frames. The bolts 114 & 114' securing said brackets 112 & 112' are simply inserted into the holes 110 & 110' that allow for the closest fit of said corner brackets 112 & 112' on each corner of the vehicle chassis frame 106. If for some reason said corner brackets 112 & 112' cannot be made to fit the vehicle frame 106 corners on a particular vehicle, then said brackets 112 & 112' can be bolted onto the angled cross-piece member 108 along the front of the vehicle chassis frame 106 in such a way so as to prevent rear movement of the vehicle mounting frame 16 relative to the vehicle frame 106. Some drilling and tapping of the front of the vehicle chassis may be necessary to attach securely said corner brackets 112 & 112' in place.

A similar parallel set of holes 116 & 116' is provided on the each side of the rear portion of the vehicle mounting frame main surface 100 as shown in FIG. 10. These are provided so that the respective connecting brackets 118 & 118' can be attached at an appropriate dimension transversely from each other so that the top vertical surface 120 & 120' of each bracket 118 & 118' will mate with the appropriate vertical surfaces 122 & 122' of each respective C-mounting clamp attachment 124 & 124' which is in turn attached to the main chassis frame 106 of the vehicle on each side. The vertical surfaces 120 & 120' and 122 & 122' of each respective connecting bracket 118 & 118' and each C-mounting clamp 124 & 124' attachment on each side of the vehicle are then bolted together.

This vehicle mounting frame design is novel in that it affords a means by which the same vehicle mounting frame 16 can be attached to a variety of different vehicle chassis frames of different sizes and dimensions without welding or significant custom fit-up. The C-clamp attachment 124 is itself unique in that its design permits means of secure attachment to the vehicle in a variety of different ways. The means shown in FIG. 10, is by means of a bolt 126 passing through one side of the C-clamp attachment 124 through drilled holes through the vehicle attachment 124. However, threaded U-clamps may also be passed over the top of the vehicle chassis frame 106 where possible and connected through holes 132 on each side of the top of the C-clamp attachment 124. Finally, a bolt (not shown) may be screwed into the side of the C-clamp attachment 124 that has a nut 128 welded to it and then tightened (clamped) against the side of the vehicle frame 106 and locked with a lock nut (not shown). Neither of these latter two methods (not shown) of attachment of the C-clamp attachment 124 require any welding of drilling through the vehicle chassis frame 106.

The C-clamp attachment 124 (& 124') revealed in FIGS. 10 & 11, consists of a U-shaped piece of steel 130 with the ends turned out at 90 degrees and appropriate bolt holes 132 provided in each turn-out. C-clamp shaped pieces of steel 134 are welded to each end thereby enclosing and reinforcing the U-shaped piece 130. Separate steel side plates 122 with appropriately placed bolt holes 136 are then welded at each end on each side of the attachment to the protruding ends of the C-clamp shaped pieces 134. Aligned holes 138 are provided in each side of the U-shaped piece in a center location such that the holes are not blocked by the side plates 122. A threaded nut 128 is welded over one of these holes 138 on one side of the U-shaped piece 130. The U-shaped piece 130 is sized so as to be able to fit over the largest of small vehicle chassis frames. When used on vehicle chassis frames which are smaller (thinner) than the inside dimension of the C-clamp attachment 124, an appropriately sized shim is used to fill any gap which may exist between the inside of the C-clamp attachment 124 and the vehicle chassis frame 106.

The C-clamp attachment 124 (& 124') revealed in FIGS. 10 & 11, consists of a U-shaped piece of steel 130 with the ends turned out at 90 degrees and appropriate bolt holes 132 provided in each turn-out. C-clamp shaped pieces of steel 134 are welded to each end thereby enclosing and reinforcing the U-shaped piece 130. Separate steel side plates 122 with appropriately placed bolt holes 136 are the welded at each end on each side of the attachment to the protruding ends of the C-clamp shaped pieces 134. Aligned holes 138 are provided in each side of the U-shaped piece in a center location such that the holes are not blocked by the side plates 122. A threaded nut 128 is welded over one of these holes 138 on one side of the U-shaped piece 130. The U-shaped piece 130 is sized so a to be able to fit over the largest of small vehicle chassis frames. When used on the vehicle chassis frames which are smaller (thinner) than the inside dimension of the C-clamp attachment 124, an appropriately sized shim is used to fill any gap which may exist between the inside of the C-clamp attachment 124 and the vehicle chassis frame 106.

FIGS. 12 & 13, reveal the novel interior arrangement and design of the preferred embodiment of the remote line control device 36 which is located on the passenger side of the vehicle. It consists of a multi-part top horizontal member 140 made of a lighter softer material like aluminum or plastic. This member is adjustable length-wise by means of a bolt 142 attached to an inner sliding plate 144 which passes through a slot 146 of pre-determined length in one (vehicle interior side) of the two outer horizontal fixed plates 144*a* & 144*b*. The bolt 142 and the inner sliding plate 144 to which it is attached can be moved in the slot 146 thereby adjusting the length of the horizontal member 140 and retaining the sliding plate 144 at the desired length by means of a thumb nut 148. This allows for adjustment to various sizes of windows. The non-sliding portion of the top horizontal member 140 consists of three plates connected together in such a way that the middle plate 150 and the inner sliding plate 144 in line with it offset or stick upwards into the vehicle door window slot 152 that normally receives the top of the closed window 154. Conversely, on the lower side of the top horizontal member 140, the offset of the middle plate 150 and the inner sliding plate 144 in relation to the outer fixed plates 144*a* & 144*b* are such as to form a gap or groove in the lower side that can receive the window 154 as it is rolled up as far as possible with the top horizontal member 140 in place. This design results in a mounting that is both solid and fills what would otherwise be a gap left by a partially open window 154 that cannot be fully closed. It is also extremely easy to install and remove simply by opening and closing the window 154. Attached to the top horizontal member 140 in its forward solid part is a vertical member 156 which is also adjustable in length by means of a bolt 156 attached to a lower part 160 which passes through a slot 164 of pre-determined length in an upper attached part 162. The bolt 158 and the lower part 160 to which it is attached can be moved in the slot 164 thereby adjusting the length and retaining it at the desired length by means of a thumb nut 166. This allows this vertical member 156 to be extended right down to the lower interior ledge 168 of windows of differing heights where the lower edge of the adjustable vertical member 156 can rest and be rigidly held in place.

A spring-loaded line retracting device 170 is mounted on the lower end of the vertical member 156 on a swivel bracket 172 in such a way that it can be swung from side to side about a pivot point in the swivel bracket 172. The line retracting device 170 is of a commercial clothes line or dog leash variety. However, it is customized in such a way so as to include an extension arm 174 which extends some distance toward the operator of the vehicle so to be in convenient reach of the operator. A bullet block 176 is attached to the end of this extension arm 174 closest to the vehicle operator.

At the center of the intersection of the top horizontal member 140 and the vertical member 156, a hole 178 is provided into which a support pipe 180 is mounted protruding an inch or two on the outside of the vehicle (see FIGS. 13 & 13A). An inner pipe 182 of a size so as to be able to fit just inside the diameter of the support pipe 180 is inserted into the support pipe 180 with its interior side end locked just inside the interior end of the support pipe 180 with a device such as a circlip 184. The exterior end of this inner pipe 182 is connected to a bracket 186 that has a hole of the same size as and is aligned with the inner pipe 182 end hole. This bracket 186 in turn is fastened to a receiving tube 188 outside the vehicle which encloses a cheek block 190 mounted so that its entrance/exit hole is aligned with that of the bracket 186 and the inner pipe 182 and directed so that line 34 passing into the front end of the receiving tube 188 and then bending approximately 90 degrees around the cheek block 190 wheel, will be directed through the bracket 186 hole and inner pipe 182 to the spring-loaded cam cleat 38 then to the bullet block 116 and then to the line retracting device 110.

The line 34, going in the other direction from the front of the receiving tube 188 in this embodiment, runs forward from the hole in the middle of the front of the receiving tube 188, and on to a moving cascade bullet block 32 (previously referred to) which is attached to the line 26 running from the 8:1 block and tackle arrangement 22 through the bullet block 28 attached to the end of the outrigger boom 30 (FIG. 1). After passing through the moving cascade bullet block 32, the line 34 from the receiving tube 188 goes back to the receiving tube 188 where it is dead-ended (in this embodiment) around the support pipe 180 (FIG. 13). Because the inner pipe 182 is free to turn inside the support pipe 180, the receiving tube 188 connected to the inner pipe 182 is able to swivel in what ever vertical direction the line 34 exiting the front of the receiving tube 188 naturally takes in the direction of the end of the outrigger boom 30.

The final significant part of this remote line control device 36 is a marine type spring-loaded cam cleat 38 mounted on a bracket 192 located and shaped so that the line 34 entering the vehicle from the receiving tube 188 through the inner pipe 182 passes smoothly through the cam cleat 38 and on to the bullet block 176 mounted at the end of the line retractor extension arm 174 and from there into the line retractor 170.

This simple but novel design puts tremendous control over plow raising, stopping and lowering at the fingertips of the operator. Instead of pushing or pulling levers as with hydraulic systems, the operator reaches to the right and pulls the line 34 toward him or her to easily and quickly raise the plow with a 16:1 advantage. The excess line 34 already pulled in is automatically taken in by the line retractor 170. When the appropriate height is reached, the operator simply stops pulling and the cam cleat 38 automatically stops the line 34 thereby holding the plow at that level. To lower the plow, the operator simply releases the line 34 from the cam cleat 38 by giving it a slight upward jerk and the plow by gravity lowers back to the ground.

In practice, this remote line control device 36 operates even more automatically than described above. This is because when plowing snow for deposit into a snow bank, the plow naturally rides up the snow pile of bank at the end of every pass. When this occurs at the end of every forward pass, the line 26 in the block and tackle arrangement 22 goes slack. Since the line retractor 170 always has a retracting force on the connected lines 34 & 26, it therefore automatically retracts the resulting slack in said lines 34 & 26. When the operator backs up from the snow bank, the plow is automatically held by the cam cleat 38 at the highest pint it rose in the snow bank. And the operator very often does not have to make any further plow height adjustment at all while backing up. The operator then only has to uncleat the line 34 (slight upward jerk) to drop the plow for forward plowing.

Even when an alternative clamp-mounted remote line control device 36*a* embodiment as shown in FIG. 14, is used where no automatic line retractor is included, the actual snowplowing operation still does not always require the operator to manually raise the plow. The plow as mentioned previously raises itself when the snow plow hits the snow bank where the snow is being deposited, the operator need only take in the slack line 34 and back up the vehicle, Again the cam cleat 38 automatically holds the plow at the raised position until the operator uncleats it dropping the plow for more forward plowing.

This embodiment is clearly a much simpler version of the manual remote line control device. It consists of a conventional C-clamp 194 to which the receiving tube bracket 186 is welded at the appropriate angle along the bottom edge of the C-clamp 194. The receiving tube bracket 186 is then fastened to the receiving tube 188 just below the exit/entrance hole of the internally mounted cheek block 190. The bracket 196 to which the cam cleat 38 is mounted is also welded to the C-clamp 194 in such a way that the line 34 exiting the receiving tube 188 passes directly from the cheek block 190' in the receiving tube 188 either through, around or inside the C-clamp 194 to the cam cleat 38 and then to the vicinity of the operator. Rubber covers 198 are fitted to the clamping surfaces of the C-clamp 194 to protect the vehicle surfaces. In this embodiment, the receiving tube return line 34 is dead-ended by means of a stop knot 200 against a hole in the side wall of the receiving tube 188.

Figure 16:
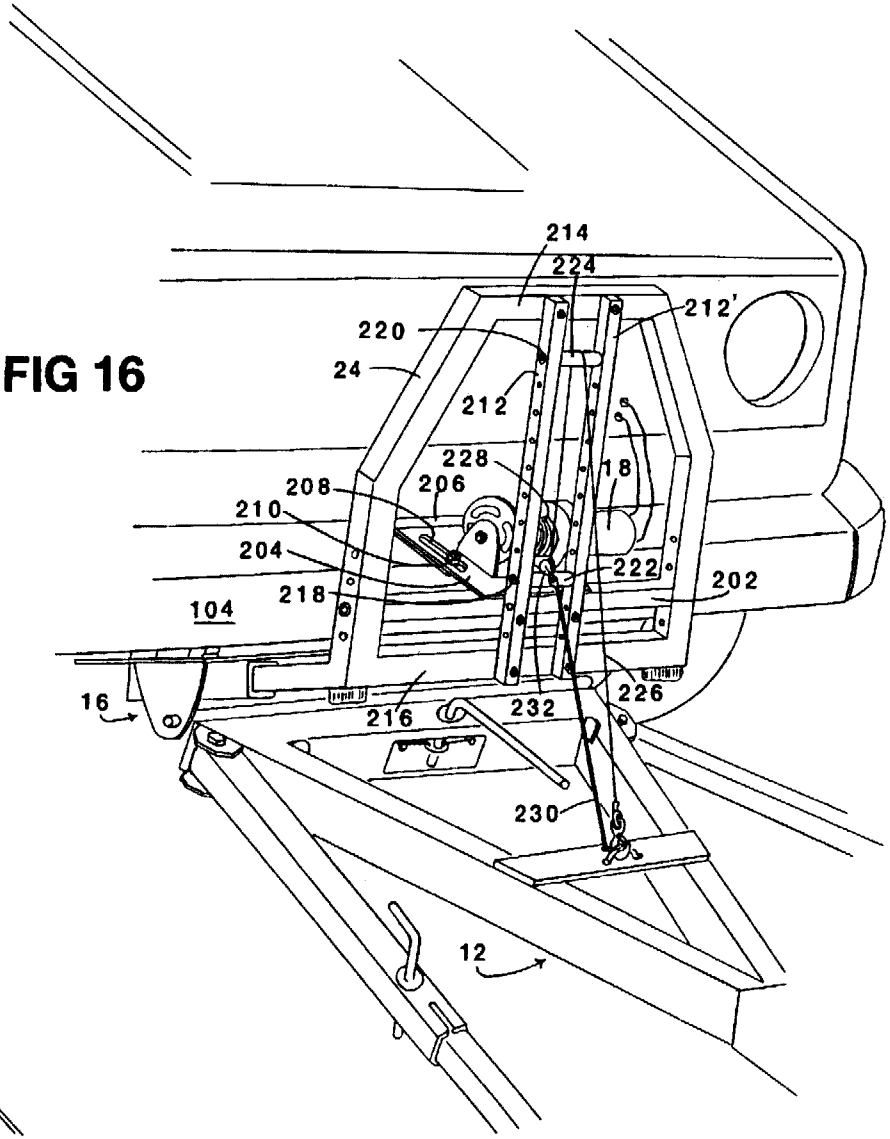
FIGS. 15 & 16 are respectively a starboard side view and a front perspective of the mounting and utilization of a conventional electric winch in conjunction with a 'fairlead ladder' mounted on the plow lifting frame as a means of remote operation (raising, stopping and lowering) of the snowplow as well as conventional winch operation.
Figure 15:
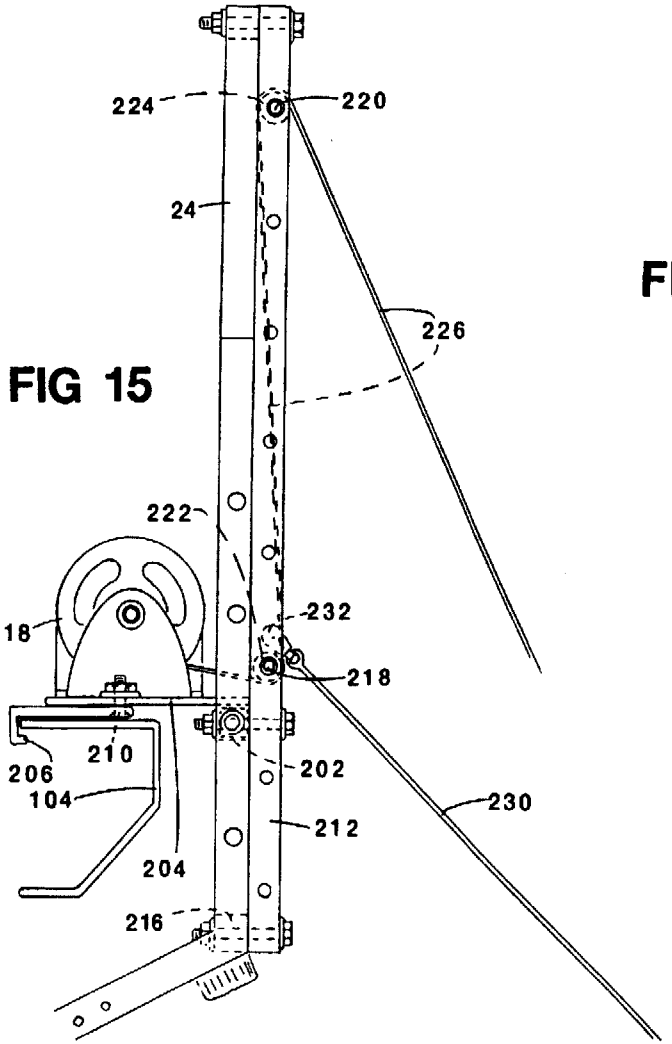

Referring now to FIGS. 15 & 16, a unique system for utilizing a conventional electric winch 18 for remote operator controlled plow raising, stopping and lowering is revealed. The system is unique because of the flexibility it provides in adapting an existing 'in-bumper mount', 'top-bumper mount' or the illustrated combination bumper 104/plow lifting frame 24 mounted winch arrangement, which, in any of the above arrangements, allows the winch 18 to be utilized for conventional winching purposes and for plow operation purpose without re-mounting the winch 18 or de-coupling the plow assembly.

The embodiment shown in FIG. 16 consists of an additional tubular cross-piece 202 which is inserted horizontally across the vertical face of the plow lifting frame 24 at a height approximately equal to the top of the front bumper 104. This cross-piece 202 is then bolted securely in place at each end through pre-located holes in either side of the plow lifting frame 24. Bolted or welded to the middle of the top of this cross-piece 202 is a rectangular steel plate 204 to which the electric winch 18 can be mounted. Bolted to the bottom of this plate 204 is another similar steel plate 206 which has a 90 degree lip on its rear edge, and which rear edge further forward is again bent down at 90 degrees so as to be able to wrap around the rear of the top of the vehicle bumper 104, thereby achieving the need rigidity for conventional winch operation and additional rigidity for the vehicle mounting frame 16 and the plow lifting frame 24. This latter steel plate 206 is adjustable fore and aft by means of fore and aft running parallel slots 208 on either side of the upper steel plate 204 in which the bolts 210 in the lower steel plate 206 can slide until the right adjustment is achieved in relation to the bumper 104. Then the bolt's nuts 210 are tightened securing the two plates 204 & 206 tightly together. The combination of the previously referred to fore and aft and vertical adjustability of the plow lifting frame 24, the vertical adjustability of the cross-piece 202 and the horizontal fore and aft adjustability of the steel plates 204 & 206 on which the winch 18 is mounted provide tremendous flexibility in mounting an electric winch 18 securely in a normal position above a vehicle bumper 104, wherein when said lifting frame 24 is removed from the vehicle mounting frame 16 so is the winch 18 and its mounting.

Whether said conventional winch 18 is mounted as just described and illustrated, or in the bumper or directly on the bumper (latter two not shown), it should be clear an additional problem must be overcome in order to efficiently utilize said winch for plow operation; or depending on how high the moldboards may be in relation to the height of the winch, for conventional winch operation. This problem is that of redirecting the winch cable 226 from the height of the winch 18 to a height adequate to efficiently raise and lower the plow; or to clear the height of the plow moldboards in the case of conventional winch operation. Many conventional electric winches have a built-in fairlead bracket (not shown) which further restricts the ability to lead the cable 226 from the winch in any direction but almost straight ahead of the winch 18.

This problem is overcome by the 'fairlead ladder' revealed in FIGS. 15 & 16. Said 'fairlead ladder' is comprised of two parallel steel members 212 & 212' which are each bolted vertically to the cross-piece 202 (approximately the same distance apart from each other as the width of the winch drum 228), to the top horizontal member 214 of the plow lifting frame 24 and the bottom horizontal member 216 of the plow lifting frame 24. Said parallel members 212 & 212' may be reinforced in any way necessary to provide the necessary strength and rigidity necessary to the loads being winched. No reinforcement is necessary for the illustrated snow plow arrangement and many conventional winching operations. Holes are provided along the entire length of both parallel members 212 & 212' aligned in a manner so that two steel pins, bolts or dowels 218 & 220 (FIG. 15) can be inserted, at any appropriate location along the parallel members 212 & 212', first through one parallel member 212 then respectively through cylindrical rollers 222 & 224 of the same length as the distance between the two parallel members 212 & 212', and then through the other parallel member 212', thereby forming the two 'rungs' of the 'fairlead ladder'. Said pins 218 & 220 are held in place at one or both ends by threaded nuts, circlips or cotter pins (not shown). With the two rollers 222 & 224 in place at appropriate locations, the winch cable 226 can be led directly forward beneath the lower roller 224 and then up behind and over the upper roller 224 and from there connected to the plow frame 12 for plow operation or led straight ahead for a winching operation which requires greater height.

Finally, FIGS. 15 & 16, reveal a unique method for dealing with the problem of excess slack in the winch cable 226 which will be inevitable at times when said winch 18 is used for plowing operations. This is because the typical conventional winch 18 has no automatic means for ceasing to unreel when the plow is lowered and reaches the resting position on the ground. The operator stops, by remote control switch from the drivers seat, the winch unreeling by feel, sight or sound, and inevitably some over-unreeling will occur resulting in excess slack in the winch cable 226. This excess slack in the winch cable 226 can cause snarls in the winch cable 226 on the winch drum 228 or can result in the winch cable 226 getting wrapped around or caught on some other protrusion. This problem is solved by an elastic cord (bungee) 230 which is connected at one end to the plow frame 12 and at the other end to a bullet block 232 through which the winch cable 226 is led as it passes between the lower roller 222 and the upper roller 224 of the 'fairlead ladder' previously described. If necessary to keep the block 232 from getting beneath the lower roller 222, a small bracket (not shown) can be mounted horizontally in front of and parallel to said roller 222 from vertical member 212 to vertical member 212' just below the block 232 and the elastic cord 230 attached to it. This arrangement ensures the 'take up' and control of any excess winch cable 226 slack. The bullet block 232 is fitted with a removable pulley wheel so that the block 232 can be readily removed from the winch cable 226 when the winch 18 is not being used for snow plowing operations or when the plow is removed.

Referring now to FIGS. 17, 18, & 19, a unique method for plow raising, stopping and lowering that requires only that the operator of the vehicle drive the vehicle forward to plow and to drive it backward, the plow automatically lifting off the ground and staying there with the rear movement of the vehicle, to prepare for another forward plowing pass. This arrangement completely eliminates the need for a plow lifting frame 24, thereby uncomplicating and lightening the overall weight of the plow components. Elimination of the plow lifting frame 24 also means that there is one less device to install or remove from the vehicle. Further, since the vehicle is no longer bearing the weight of raising the plow off the ground via the plow lifting frame, lighter trucks and cars can more readily be outfitted for snowplowing.

FIG. 17, depicts the plow with the moldboard 14 on the ground in the forward plowing position. Attached to the plow frame 12 is an automatic lifting mechanism which consists of a biased (longer on one side than the other) cam 234 which is suspended from an axle 236 which is mounted transversely on the plow frame 12. The biased cam 324 is mounted transversely on the plow frame 12. The biased cam 234 is mounted on the axle by means of a pipe 238 (FIG. 19 & 19A) through which the axle 236 is run, which pipe 238 is notched at each end for a distance of approximately 125 degrees allowing room for stops 240 & 240' to be inserted in the axle 236 in such a way that the biased cam 234 and the notched pipe 238 said biased cam 234 is fixedly mounted on is free to rotate approximately 125 degrees before the stops 240 & 240' come in contact with the notches at either end of the pipe 238.

FIG. 18, shows the raised plow with the vehicle moving in reverse. If the vehicle stops its rearward motion, and begins to move forward, the biased cam 234 which has been dragging loosely on the ground when the vehicle was in reverse because it is free to rotate for approximately 125 degrees in a clockwise direction, now engages the ground with its longer side treaded surface 242 and is forced to roll or rotate in a counter-clockwise direction. As it does so the notches in the ends of the pipe 238 come in contact with the stops 240 & 240' in the axle 236 forcing the axle 236 also to rotate in a counter-clockwise direction. Swivel castor wheels 244 & 244' of a height slightly less than that of the longer side of the biased cam 234 and fixedly mounted at each end of the axle 236 lift slightly off the ground and must also rotate in a counter-clockwise direction approximately the same distance that the biased cam 234 does, which is far enough to rotate the castor wheels 244 & 244' up and out of the way as the rotation of the biased cam 234 to its shorter side also lowers the plow moldboard 14 to the ground. At this point the biased cam 234 stops its rotation and simply drags lightly along the ground with the forward motion of the plow while holding the castor wheels 244 & 244' up off the ground in the position shown in FIG. 17.

Conversely, when forward plowing motion stops and the vehicle reverses direction, the treaded surface 242 of the shorter side of the biased cam 234 engages the ground and is forced to begin a clockwise rotation or roll that allows the castor wheels 244 & 244' to rotate clockwise by gravity with the rolling cam 234. Because of the bias of the cam 234, the plow frame 12 and hence the moldboard 14 are forced to rise as the biased cam 234 rolls clockwise, since the rear end of the plow frame 122 is coupled to the vehicle mounting frame 16 in a position that cannot rise. By the time the biased cam 2234 rolls clockwise far enough to lose engagement with the ground, the castor wheels 2244 & 2244' have been lowered and hold the plow in the raised position as the vehicle and plow move rearward again as shown in FIG. 18. Stop arms 2246 & 2246' mounted on the tops of the castor wheels 2244 & 2244' prevent, when they come in contact with the stop arm brackets 2248 & 2248', the castor wheels 2244 & 2244' from continuing in their clockwise rotation under the weight of the plow which they are now supporting. The treaded surface 242 of the biased cam 2234 has a convex shape that is such that the angles formed by a line perpendicular to the ground and running through the center of the axle 236 and any lines also running through said axle 236 center to whichever tread has just touched the ground during the continuous roll clockwise or counter-clockwise of said treaded surface are approximately equal.

Depicted in FIG. 18, by the dashed line direction arrow, the dashed line castor wheel **244*a*, the dashed line biased cam 234*a*, and the dashed line stop arm lock 250*a* (the solid line stop arm lock 250 is in the unlocked position) is a simple method for holding the biased cam 234*a* up out of the way and the castor wheel(s) 244*a* locked in the down position when vehicle movement in the forward direction as well as the rear direction is desired with the plow in the raised (non-plowing) position such as when moving from place to place over surfaces that don't need plowing or putting the plow in the garage. The biased cam 234*a* is held up out of the way by a pin 252 which is inserted through a hole in the short side corner of the biased cam 234*a* and rested on top of the plow frame 12 (see also FIG. 21). The castor wheel(s) 244*a* is held in the locked position by the stop arm lock 250 simply by turning it to the position of 250*a* where it prevents counter-clockwise movement of the stop arm(s) 248 holding it in a fixed position. This simple but automatic raising, stopping and lowering arrangement is a significant improvement in prior art. It should be apparent that this automatic lifting mechanism can take on different forms such as multiple biased cams and one wheel or multiple wheels, and be mounted in many different ways and in different or multiple locations such as on moldboard 14 & 14' rather than the plow frame 12**.

It should be fairly obvious from FIG. 17, that this automatic lifting device also affords further convenience in coupling and de-coupling the plow frame 12 to and from the vehicle mounting frame 16. An operator who has driven forward to a position to de-couple the plow need merely leave the biased cam 234 in the position it is in after de-coupling and it will hold the rear of the plow frame 12 at the exact height it needs to be for re-coupling to the vehicle. If for some reason the coupling height changes the next time the plow frame 12 is to coupled to the vehicle mounting frame 16, the height of the rear of the plow frame 12 is easily adjusted by rotating the biased cam 234 in a manner to give the desired height. This automatic lifting mechanism, the quick-hitch/release mechanism, the outwardly angled centering flanges, and the positioning guides previously described in FIGS. 7 & 8, individually and in combination yield significant improvement in prior art with respect to simple and convenient plow coupling and de-coupling.

Figure 21:
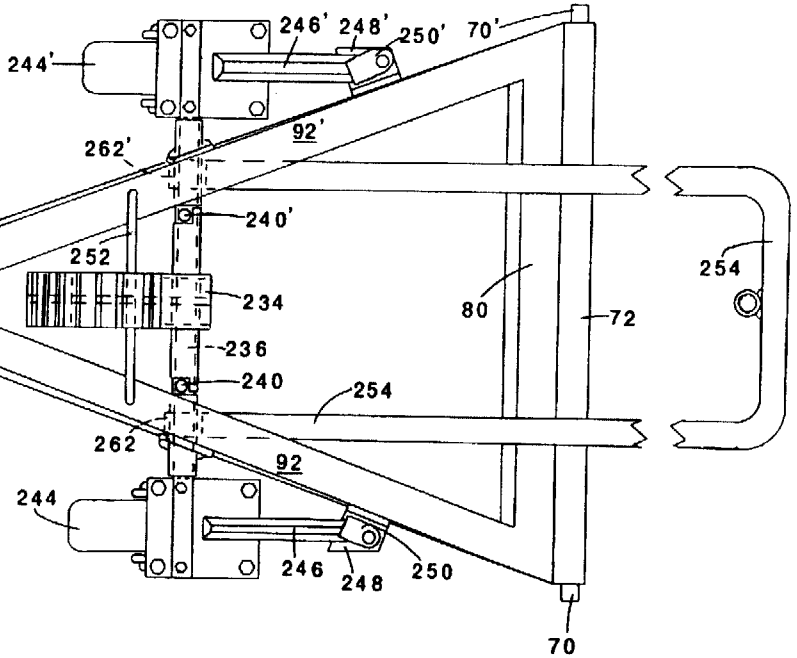
FIG. 21 is a top view of the de-coupled plow assembly again able to easily moved about on the swivel castor wheels except that the leverage handle in this view is positioned for handling from the rear of the assembly.
Figure 20:
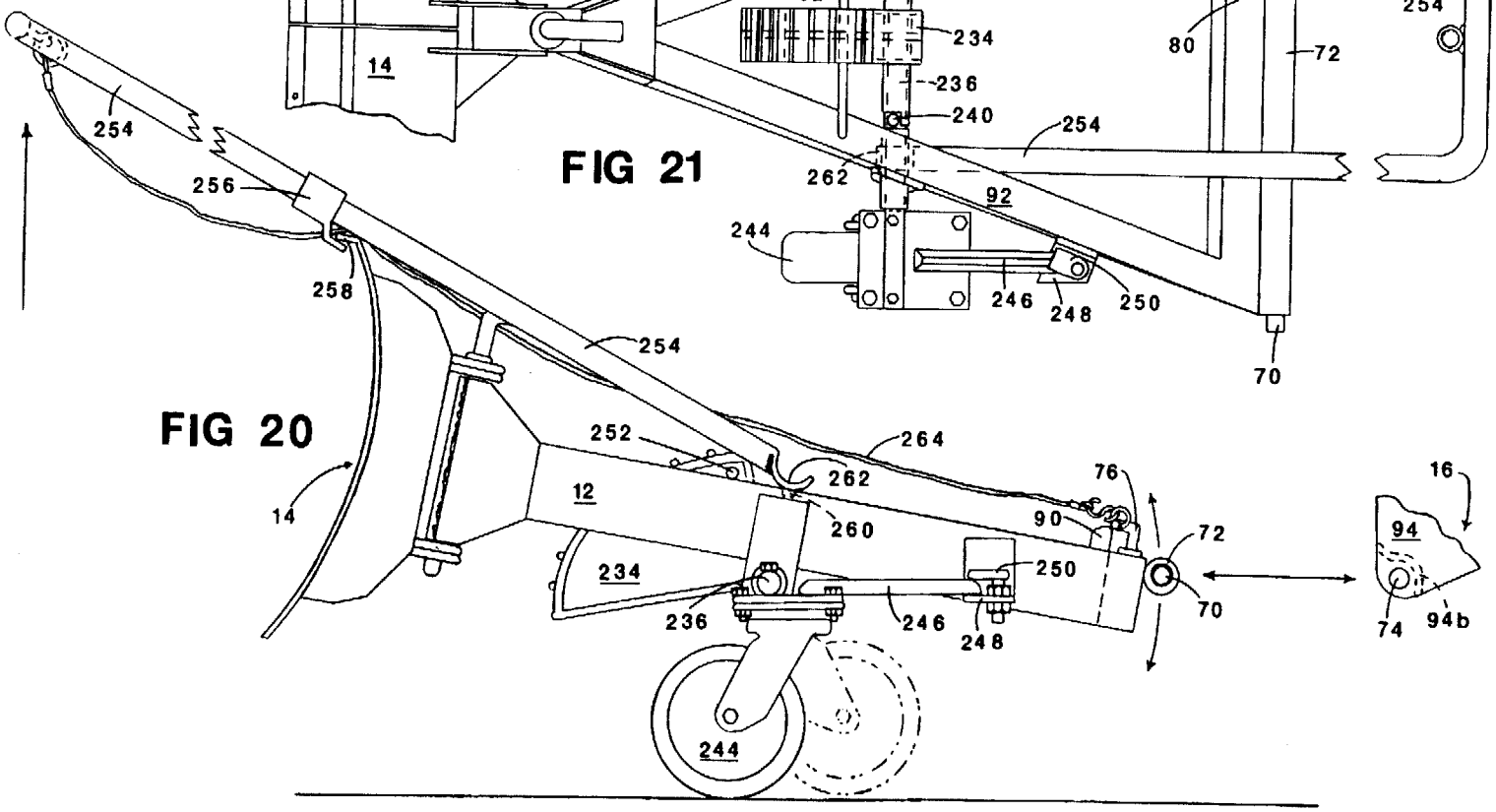
FIG. 20 is a port side view similar to FIG. 18 except the plow assembly is de-coupled from the vehicle mounting frame and is easily moved about by means of a leverage handle and swivel castor wheels including to and from the coupling position with the vehicle mounting frame.

FIGS. 20 & 21, reveal an easy method for manually moving around the assembled snowplow when it is not coupled to the vehicle, by means of a leverage handle 254 which is approximately 5' long and the swivel castor wheels 244 & 244'. FIG. 20, illustrates how the leverage handle 254 is attached from the front of the plow by means of an adjustable clip(s) 256 which is slipped under the horizontal top lip(s) 258 of the moldboard(s) 14 after the locating button(s) 260 located on the bottom of the arc-shaped ends 262 & 262" of the leverage handle 254 is positioned in its respective hole located on the top of each respective plow frame member 92 & 92' above the transverse axle 236. With the swivel castor wheels 244 & 244' locked in the down position, this arrangement allows an individual, by lifting the handle 254 with the extra leverage provided by it in 'wheel barrow' fashion, to pick up and walk and turn the plow around to any location or position desired. It provides the added tremendous advantage of being able to walk the plow assembly to the vehicle for coupling rather than vice-versa, and further, and just as importantly, it provides a ready means for adjusting the height of the rear of the plow frame 12 as it is being positioned for coupling with the vehicle mounting frame 16, because of the pivoting action that occurs over the castor wheels 244 & 244' which raises the rear of the plow frame 12 when the handle 254 is lowered, and lowers the rear of the plow frame 12 when the handle 254 is raised. If the outwardly angled centering flanges **94*a* & 94*a'* and positioning guides 94*b* & 94*b'* previously referred to in FIGS. 7, 8, & 9, are in place, all one need do to couple the plow assembly is walk it over to the vehicle and push the rear of the plow frame 12 between the centering flanges 94*a* & 94*a'* on the vertical surfaces 94 & 94' of the vehicle mounting frame 16, and all the coupling is completed automatically. If said centering flanges 94*a* & 94*a'* are not in place, then the lever arm 76 need only be rotated to a position behind one of the retaining cams 90 thereby retracting the protruding coupling pins 70 & 70', which allows the plow assembly and hence the rear of the plow frame 12 to be wheeled into coupling position between the vertical surfaces 94 & 94' of the vehicle mounting frame 16. When the rear of the plow frame 12 is properly aligned inside the vertical surfaces 94 & 94' of the vehicle mounting frame 16 (which occurs automatically if the positioning guides 94*b* & 94*b'* are in place on the inner vertical surfaces 94 & 94' of the vehicle mounting frame 16), the cord 264 is tugged by the handler which releases the lever arm 76 again resulting in the automatic coupling of the plow frame 12 to the vehicle mounting frame 16**.

Because de-coupled snowplow assemblies get placed in a variety of locations such as with the plow blade up against a wall, it is not always possible to mount the leverage handle from the front of the plow assembly as shown in FIG. 20. As depicted in FIG. 21, the same leverage handle 254 can be mounted from the rear of the plow assembly by simply placing the arc-shaped ends 262 & 262' in position below the axle 236 mountings and pressing down on the handle 254 which in cantilever fashion presses down on the rear member 80 of the plow frame 12, thereby lifting in pivot fashion and with the leverage afforded by the handle 254, the plow blade off the ground, again allowing for almost infinite wheeling about of the de-coupled plow assembly by hand.

Figure 24:
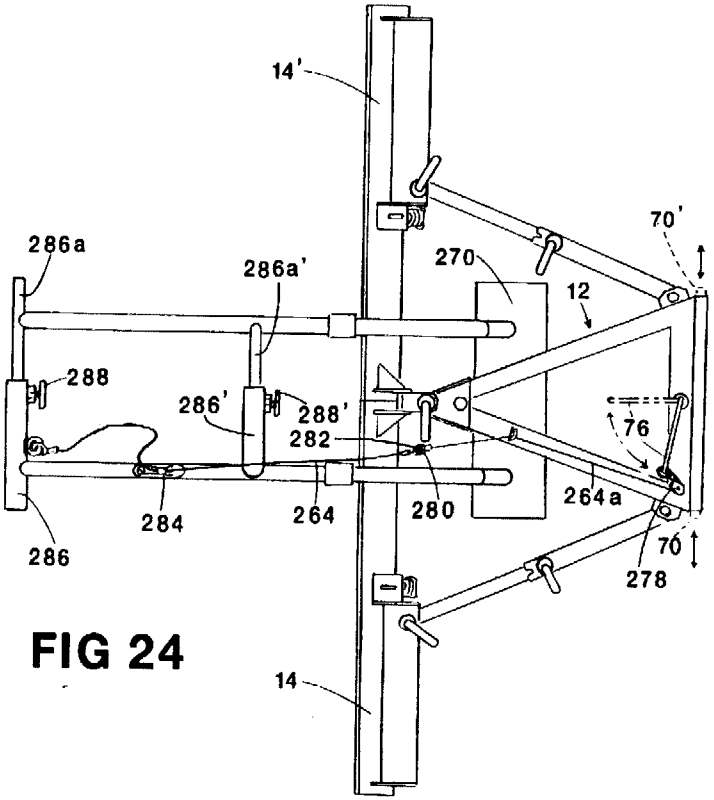
FIG. 24 is a top view of the leverage handle and dolly platform in use on a snowplow assembly that is fitted with a quick-hitch/release mechanism and rigged so that the quick-hitch/release mechanism is remotely operable by the operator at the handle end of the leverage handle.
Figure 22:
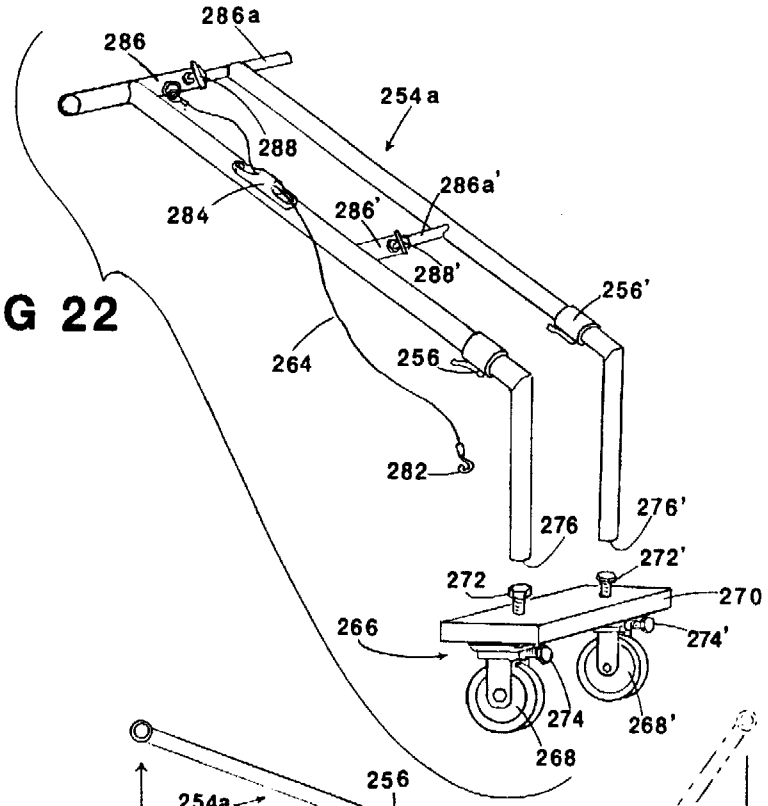
FIG. 22 is a perspective of the the leverage handle and dolly platform, which when utilized together, afford means for the easy manual transport of almost any light snowplow.
Figure 23:
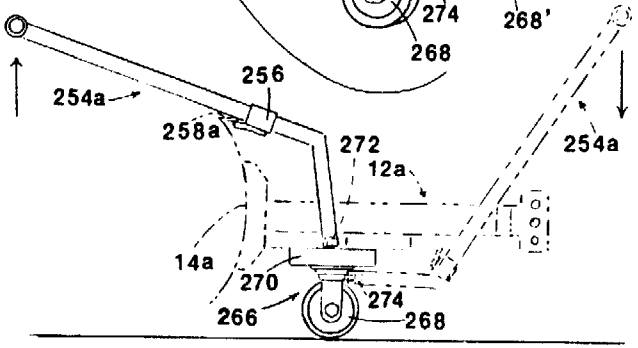
FIG. 23 is a side view of the leverage handle mounted in both the front and rear positions, and dolly platform as they are used in manually transporting a light snowplow.

FIGS. 22, 23 & 24, reveal a novel adaptation of the manual transport means depicted in FIGS. 20 & 21, which adaptation allows for the said method of manual transport to be utilized on almost any light snowplow. FIG. 22, is a perspective of the two parts of the manual transport device. The first part is the leverage handle **254*a*, which is an appropriately shaped arm of pipe, bar, rod or tube, and the second part is the dolly platform 266. The dolly platform 266 is made up of one or more (two in this embodiment) castor wheels 268 & 268' which are mounted underneath a flat rectangular platform 270 which may be made of wood or other material of similar strength. Connecting means (bolts in this embodiment) 272 & 272' and 274 & 274' are respectively provided in positions on top of the platform 270 (for front mounting) and below and to the rear of the platform 270 (for rear mounting), corresponding to the respective connecting means 276 & 276' at the ends of the leverage handle 254*a*. As shown in FIGS. 22 & 24, the leverage handle 254*a* may be provided with means for width adjustment so as to be able to fit almost any plow assembly configuration. In this embodiment, that adjustability is achieved by means of connecting pipes 286 & 286' and 286*a* & 286*a'* respectively, which are adjustable by means of their telescopability within each other and stopping screws 288 & 288' which are mounted on pipes 286 & 286' respectively. Adjustability of the width of the connecting bolts 272 & 272' and 274 and 274' on the dolly platform 266 to match the width of the adjustable connecting ends 276 and 276' of the leverage handle 254*a*, is achieved either by moving on platform 270 the connecting bolts 272 & 272' and/or the castor wheels with connecting bolts 274 & 274' mounted on them, or by designing the platform 270 itself to be width adjustable. When the dolly platform 266 is placed beneath the plow frame 12*a* of a plow assembly as in FIG. 23, in close proximity to the rear side of the moldboard 14*a*, the leverage handle 254*a* may then be attached and used to manually transport the plow assembly from the front or the rear (phantom lines) of the plow assembly as shown in FIG. 23**.

When the leverage handle **254*a* is connected from the front, adjustable clips 256 & 256', which slide on each arm of the leverage handle 254*a* are slipped under the top lip 258*a* of the moldboard 14*a*. Then, when a person lifts the leverage handle 254*a* from its outboard handle end (as indicated by the arrow), the moldboard 14*a* lifts off the ground allowing the whole assembly to be manually transported on the castor wheel(s) 268 & 268' and also allowing manual height adjustment of the rear end of the plow frame 12*a* for coupling to a vehicle. Similarly when connected from the rear, the leverage handle 254*a*, or an appropriate extension of it, rests against an after portion of the plow frame 12***a*. When a person pushes down on the outboard handle end of the leverage handle 254*a* (as indicated by the arrow), the moldboard 14*a* again is lifted off the ground in cantilever fashion, allowing the whole assembly to be manually transported on the castor wheel(s) 268 & 268'.

FIG. 24, reveals the operation of the leverage handle 254*a* and the platform dolly 266 in use mounted from the front of a plow assembly which includes a plow frame 12 which is equipped with a quick-hitch/release mechanism of the type previously described in FIGS. 7 & 8. In this embodiment, a wire 264*a* is attached to the free end of the quick-hitch/release mechanism lever arm 76 and then led through a block 278 fixedly located so that when the wire 264*a* is pulled from its free end, the lever arm 76 is pulled toward the block 278, thereby retracting the coupling pins 70 & 70'. The free end of the wire 264*a* is fitted with a connecting device, which in this embodiment is a simple loop 280. The cord 264 which is attached at one end to the outboard end of the leverage handle 254*a* is then led through a jam cleat 284 and has a hook 282 then attached to its free end (also shown in FIG. 22). When hook 282 from the cord 264 is connected to the loop 280 from the wire 264*a*, the pins 70 & 70' of the quick-hitch/release mechanism can be retracted remotely by the person at the outboard end of the leverage handle 254*a* by pulling on the cord 264. When the cord 264 is pulled, the pins 70 & 70' can be held in the retracted position (without the stops 90 & 90' shown in FIGS. 7 & 8) by stopping the cord 264 in the jam cleat 284 thus allowing the operator to use both hands for transport and positioning. Coupling to a vehicle is easily accomplished at the appropriate time simply by the operator remotely uncleating the cord 264 from the jam cleat 284.

To de-couple the plow assembly from a vehicle, the operator simply mounts and connects the leverage handle 254*a* in the same way. When ready, the operator merely has to pull the cord 264 until the plow assembly pops free ready for manual transport. The improvement in transporting and coupling and de-coupling a snowplow to and from a vehicle without the operator ever having to get behind the moldboard 14 should be self-evident.

Having thus described the invention with particular reference to the preferred forms thereof, it will be obvious that various changes and modifications may be made therein without departing from the spirit and scope of the invention as defined in the appended claims.

What is claimed is:

1. Leverage handle means for facilitating the manual transport of an interconnected plow frame moldboard assembly comprised of at least one rigid arm which is angled as necessary for fit and connection, having at one first end a handle, and at a second opposite end, means for connection to a plow frame of said interconnected plow frame moldboard assembly;

wherein manual transport of said interconnected plow frame moldboard assembly is facilitated by mounting said leverage handle means in a forward position on and in relation to said interconnected plow frame moldboard assembly;

wherein when said interconnected plow frame moldboard assembly is fitted with at least one castor wheel which selectively can be positioned fixedly beneath said plow frame in proximity to a rear convex shaped side of said moldboard so that a lowest part of said castor wheel extends beyond a plane formed by connecting, with an imaginary straight line, a bottom scraping edge of said moldboard and a bottom rear edge of a first double apex end of said plow frame;

wherein when said leverage handle means is mounted in said forward position and connected at first and second points to said interconnected plow frame moldboard assembly, the first said connection point being at said second opposite end of said leverage handle means and between said first double apex end and a second opposite single apex end of said plow frame, and the second said connection point being on said leverage handle means between said first handle end and said second opposite end of said leverage handle means where said leverage handle means contacts the top edge of said moldboard of said interconnected plow frame moldboard assembly, said leverage handle means provides a way of manually transporting in any direction said interconnected plow frame moldboard assembly through a use of a pulling up motion on said first handle end of said leverage handle means, utilizing said at least one castor wheel as a fulcrum so that only said at least one castor wheel is in contact with the ground surface.

2. Leverage handle means for facilitating the manual transport of an interconnected plow frame moldboard assembly as set forth in claim 1;

wherein said lowest part of said castor wheel extends far enough beyond said plane formed by connecting, with said imaginary straight line, the bottom scraping edge of said moldboard and the bottom rear edge of said first double apex end of said plow frame so that when said bottom scraping edge of said moldboard is resting on the ground, said first double apex end of said plow frame, which includes means for coupling and de-coupling to a vehicle mounting frame, automatically is raised to a height which is higher than the height of a coupling means on said vehicle mounting frame, when said interconnected plow frame moldboard assembly is de-coupled from said vehicle mounting frame, thereby facilitating, both manual transport of said interconnected plow frame moldboard assembly and control of the height and lateral horizontal movement of said coupling means at said first double apex end of said plow fine of said interconnected plow frame moldboard assembly in relation to said coupling means on said vehicle mounting frame for coupling and de-coupling.

3. Leverage handle means for facilitating the manual transport of an interconnected plow frame moldboard assembly as set forth in claim 1;

wherein manual transport of said interconnected plow frame moldboard assembly is facilitated by mounting said leverage handle means in a rearward position on and in relation to said interconnected plow frame moldboard assembly;

wherein when said leverage handle means is mountable from said forward position to said rearward position, and in contact at said first point and a third point with said interconnected plow frame moldboard assembly, and the third said point being where said leverage handle means comes in contact with a portion of said first double apex end of said plow frame, the weight of said moldboard is cantilevered off the ground surface through the use of a pushing down motion on said leverage handle means, utilizing said at least one castor wheel as a fulcrum so that only said at least one castor wheel is in contact with the ground surface, thereby facilitating manual transport of said interconnected plow frame moldboard assembly when de-coupled from a vehicle in any direction on the ground surface.

4. Leverage handle means for facilitating the manual transport of an interconnected plow frame moldboard assembly as set forth in claim 1;

wherein a dolly platform, comprised of at least one castor wheel fixedly mounted to a first flat side surface of a platform bed to which at least one connecting means is provided on a second opposite flat side surface of said platform bed, and at least one second connecting means is provided on a third side of said dolly platform, is used in conjunction with said leverage handle means;

wherein when said dolly platform, with said second connecting means on said third side of said dolly platform facing rearward toward said first double apex end of said plow frame, is placed transversely beneath and between said first double apex end and said second opposite single apex end of said plow frame in dose proximity to said rear convex shaped side of said moldboard of said interconnected plow frame moldboard assembly, the lowest part of said castor wheel of said dolly platform extends beyond said plane formed by connecting with said imaginary straight line, the bottom scraping edge of said moldboard and the bottom rear edge of said first double apex end of said plow frame;

wherein when said leverage handle means is selectively mounted from the front or the rear of said plow frame moldboard assembly, and, in either mounting selection, said leverage handle means being in contact with said interconnected plow frame moldboard assembly at said two points, one of said two points being where said second opposite end of said leverage handle means is connected to said connecting means provided respectively on said second opposite flat side surface and said third side of said dolly platform, manual transport in any direction of said interconnected plow frame moldboard assembly is facilitated through the use of a pulling up motion on said first handle end of said leverage handle means when said leverage handle means is mounted from the front, and a pushing down motion when said leverage handle means is mounted from the rear, utilizing said at least one castor wheel as a fulcrum so that only said at least one castor wheel of said dolly platform is in contact with the ground surface.

5. Leverage handle means for facilitating the manual transport of an interconnected plow frame moldboard assembly as set forth in claim 4;

wherein said lowest part of said castor wheel of said dolly platform extends far enough beyond said plane formed by connecting, with said imaginary straight line, the bottom scraping edge of said moldboard and the bottom rear edge of said first double apex end of said plow frame so that when said bottom scraping edge of said moldboard is resting on the ground, said first double apex end of said plow frame, which includes said means for coupling and de-coupling to said vehicle mounting frame, automatically is raised to a height which is higher than the height of said coupling means on said vehicle mounting frame when said interconnected plow frame moldboard assembly is de-coupled from said vehicle mounting frame, thereby facilitating both manual transport of said interconnected plow frame moldboard assembly and control of the height and lateral horizontal movement of said coupling means at said first double apex end of said plow frame of said interconnected plow frame moldboard assembly in relation to said coupling means on said vehicle mounting frame for coupling and de-coupling.

6. Leverage handle means for facilitating the manual transport of an interconnected plow frame moldboard assembly as set forth in claim 5;

wherein said leverage handle means consists of more than one parallel interconnected rigid arm;

wherein said interconnected rigid arms are adjustable in width spacing from each other as are their respective connection points on said interconnected plow frame moldboard assembly and said dolly platform in order to adjustably fit said snowplow moldboard plow frame assemblies whether selectively mounted from the front or the rear.

7. Leverage handle means for facilitating the manual transport of an interconnected plow frame moldboard assembly as set forth in claim 1;

wherein said leverage handle means also serves a purpose of providing remote means for coupling and de-coupling said plow frame moldboard assembly from said vehicle mounting frame;

wherein said leverage handle means and said interconnected plow frame moldboard assembly are fitted with connecting links which are, at one end, readily operable by an operator at said first handle end of said leverage handle means and which are, at a second end of said connecting links, connectable to an actuating lever arm of a quick-hitch/release mechanism mounted on said first double apex end of said plow frame thereby allowing the operator to perform the coupling and de-coupling operation of said plow frame moldboard assembly to and from the vehicle mounting frame from the remote position of said first handle end of said leverage handle means simply by pulling or pushing on said connecting links.

8. Leverage handle means for facilitating the manual transport of an interconnected plow frame moldboard assembly as set forth in claim 7;

wherein a stopping means is provided in combination with said connecting links on said leverage handle means, thereby allowing the operator to set said quick-hitch/release mechanism located on said first double apex end of said plow frame in a retracted position, thereby fleeing both of the operator's hands for positioning work, and affording the operator the ability to release said quick-hitch/release mechanism at will by an unstopping movement on the connecting link thereby unstopping it, further facilitating the remote coupling and de-coupling of said interconnected plow frame moldboard assembly to and flora said vehicle mounting frame.

* * * * *